US007928948B2

(12) United States Patent
Hagino et al.

(10) Patent No.: US 7,928,948 B2
(45) Date of Patent: Apr. 19, 2011

(54) MATRIX ADDRESSING CIRCUITRY AND LIQUID CRYSTAL DISPLAY DEVICE USING THE SAME

(75) Inventors: Shuji Hagino, Tokyo (JP); Hidetoshi Watanabe, Tokyo (JP); Akihiro Iwatsu, Tokyo (JP); Keitaro Yamashita, Tokyo (JP)

(73) Assignee: TPO Hong Kong Holdings Limited Corp., Shatin (HK)

( * ) Notice: Subject to any disclaimer, the term of this patent is extended or adjusted under 35 U.S.C. 154(b) by 990 days.

(21) Appl. No.: 11/659,866

(22) PCT Filed: Aug. 11, 2005

(86) PCT No.: PCT/IB2005/052665

§ 371 (c)(1),
(2), (4) Date: Feb. 8, 2007

(87) PCT Pub. No.: WO2006/018800

PCT Pub. Date: Feb. 23, 2006

(65) Prior Publication Data

US 2007/0247478 A1 Oct. 25, 2007

(30) Foreign Application Priority Data

Aug. 13, 2004 (JP) ..... 2004-236138

(51) Int. Cl.
*G09G 3/36* (2006.01)

(52) U.S. Cl. ..... 345/96; 345/79; 345/87

(58) Field of Classification Search ..... 345/54, 345/79, 96, 100, 87

See application file for complete search history.

(56) References Cited

U.S. PATENT DOCUMENTS 6,496,172 B1 * 12/2002 Hirakata ..... 345/96
6,717,563 B2 * 4/2004 Kim ..... 345/96
6,724,362 B2 * 4/2004 Min ..... 345/100

FOREIGN PATENT DOCUMENTS

JP 10-59332 3/1989

(Continued)

OTHER PUBLICATIONS

PCT International Search Report of Counterpart PCT Application No. PCT/IB2005/052665.

*Primary Examiner* — Amare Mengistu
*Assistant Examiner* — Koosha Sharifi
(74) *Attorney, Agent, or Firm* — Liu & Liu

(57) ABSTRACT

The invention aims at preventing an occurrence of artefacts while reducing power consumption. A matrix addressing method for alternately driving pixels. The frame period of the images is formed by successively sequencing on a time series a plurality of block periods, the block periods each being composed of a first half block being a period for successively sequencing on a time series application timings of the pixel voltages for one or more row electrodes to be provided with one polarity, the second half block being a period for successively sequencing on a time series application timings of the pixel voltages for one or more row electrodes to be provided with the other polarity. Ones of even-numbered row electrodes and odd-numbered row electrodes in arrangement order on the display screen are selected in the first half block. The others spatially adjoining the ones are selected in the second half block. A row electrode selecting order in the first half block and a row electrode selecting order in the second half block during one frame period are made differed from orders in the corresponding half blocks during the other frame period, respectively, so as to mitigate block-period-base visual artefact.

8 Claims, 35 Drawing Sheets

FOREIGN PATENT DOCUMENTS

| | | |
|---|---|---|
| JP | 2000-250496 | 9/2000 |
| JP | 2002-244623 | 8/2002 |
| JP | 2004-004857 | 1/2004 |
| WO | WO 03/030137 | 4/2003 |
| WO | WO 03030137 A2 * | 4/2003 |

* cited by examiner

[Fig. 1]
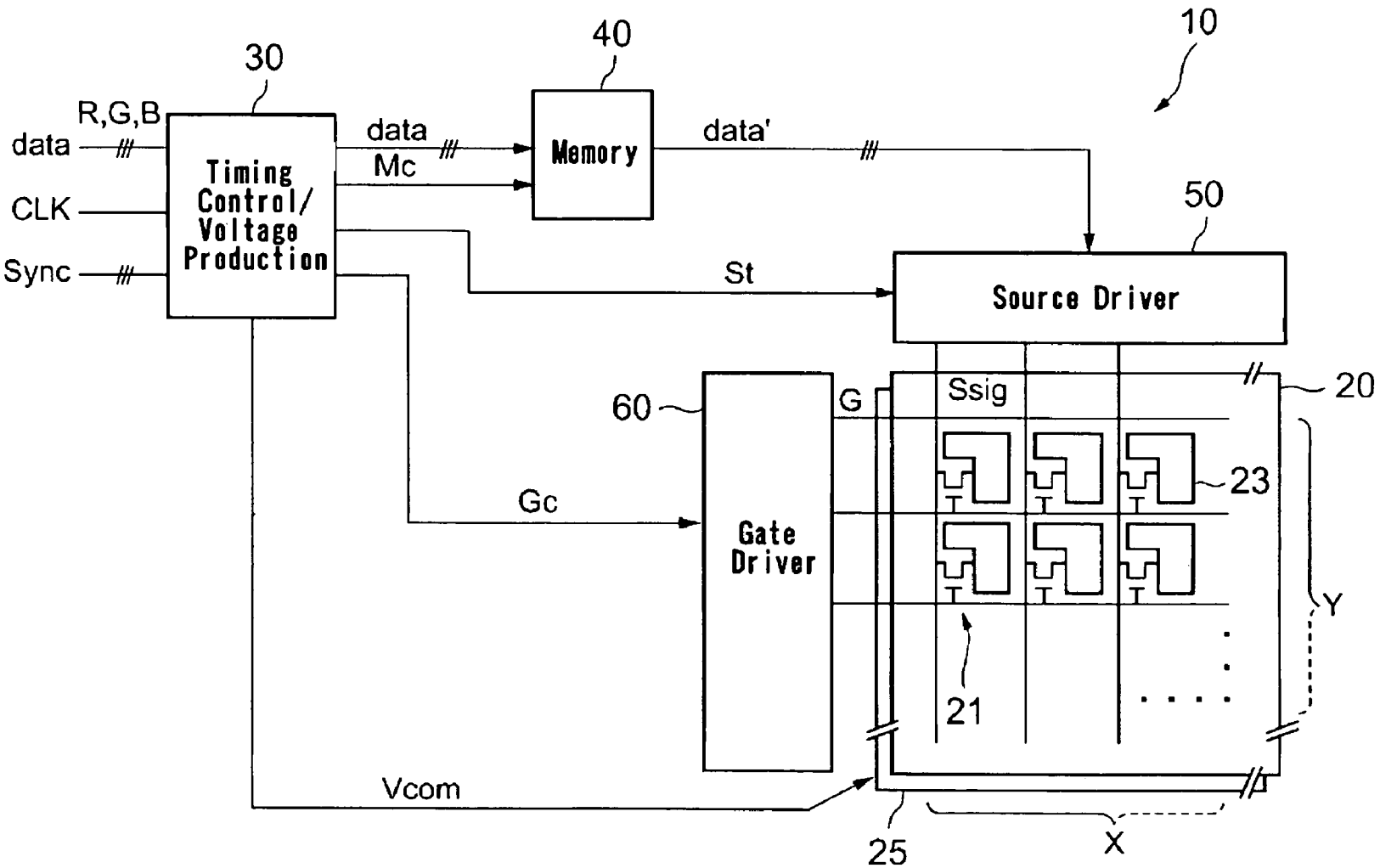

[Fig. 2]
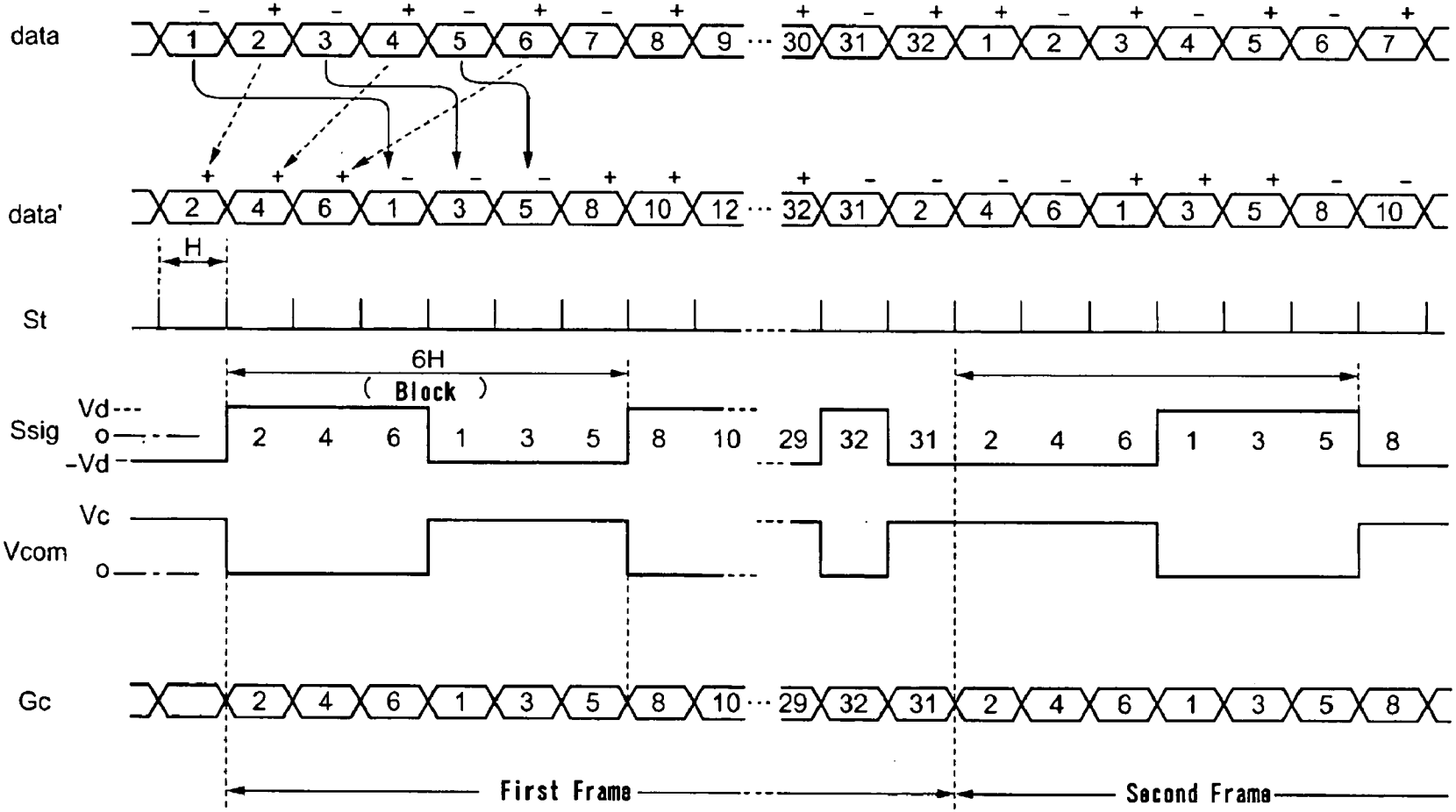

[Fig. 3]
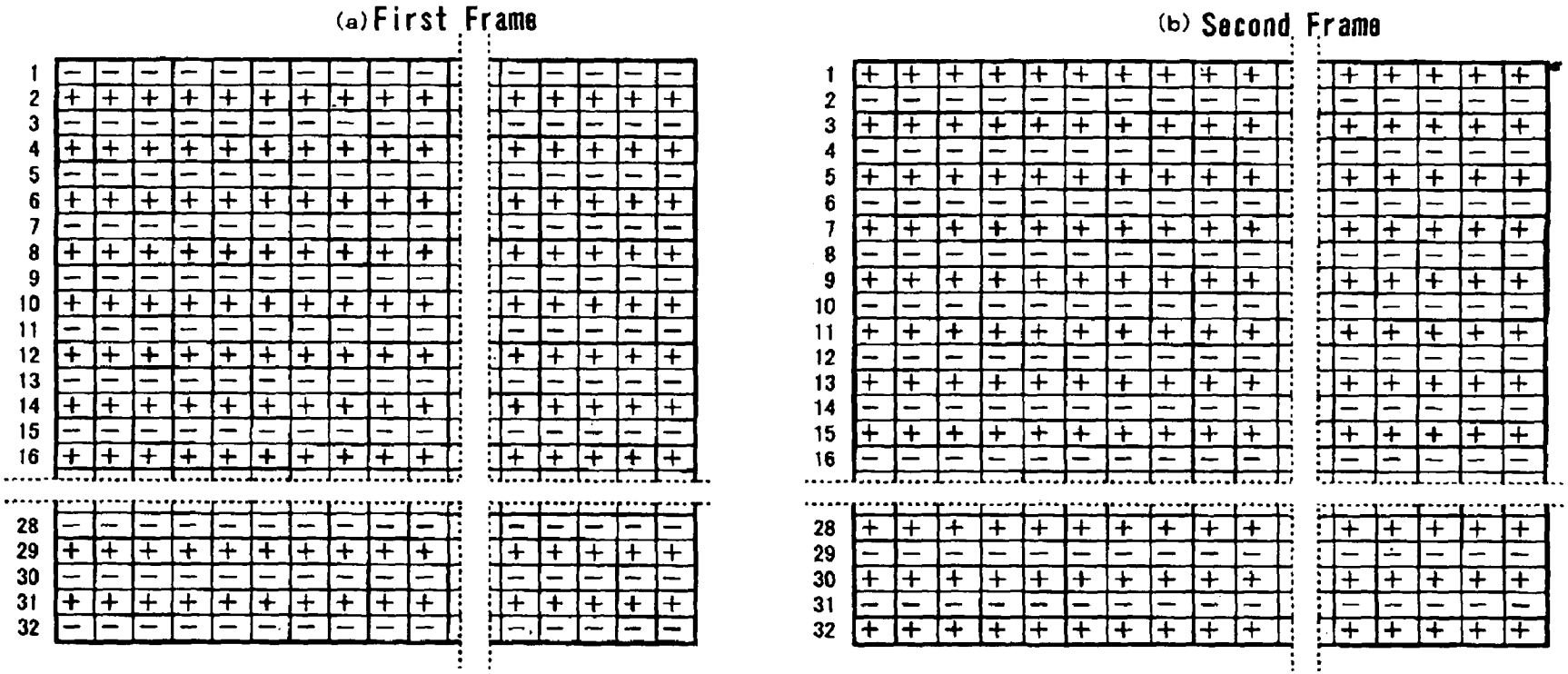

[Fig. 4]
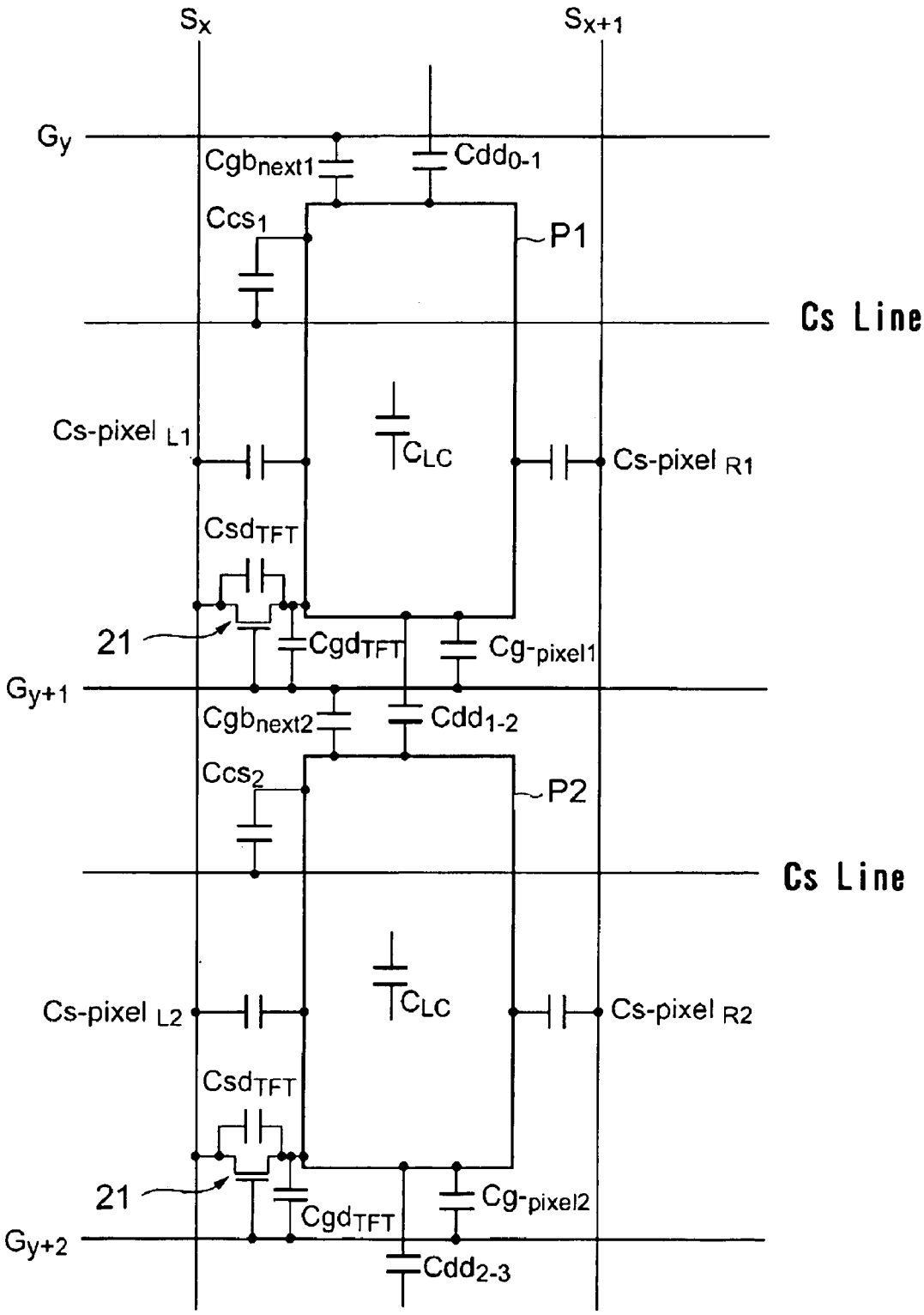

[Fig. 5]
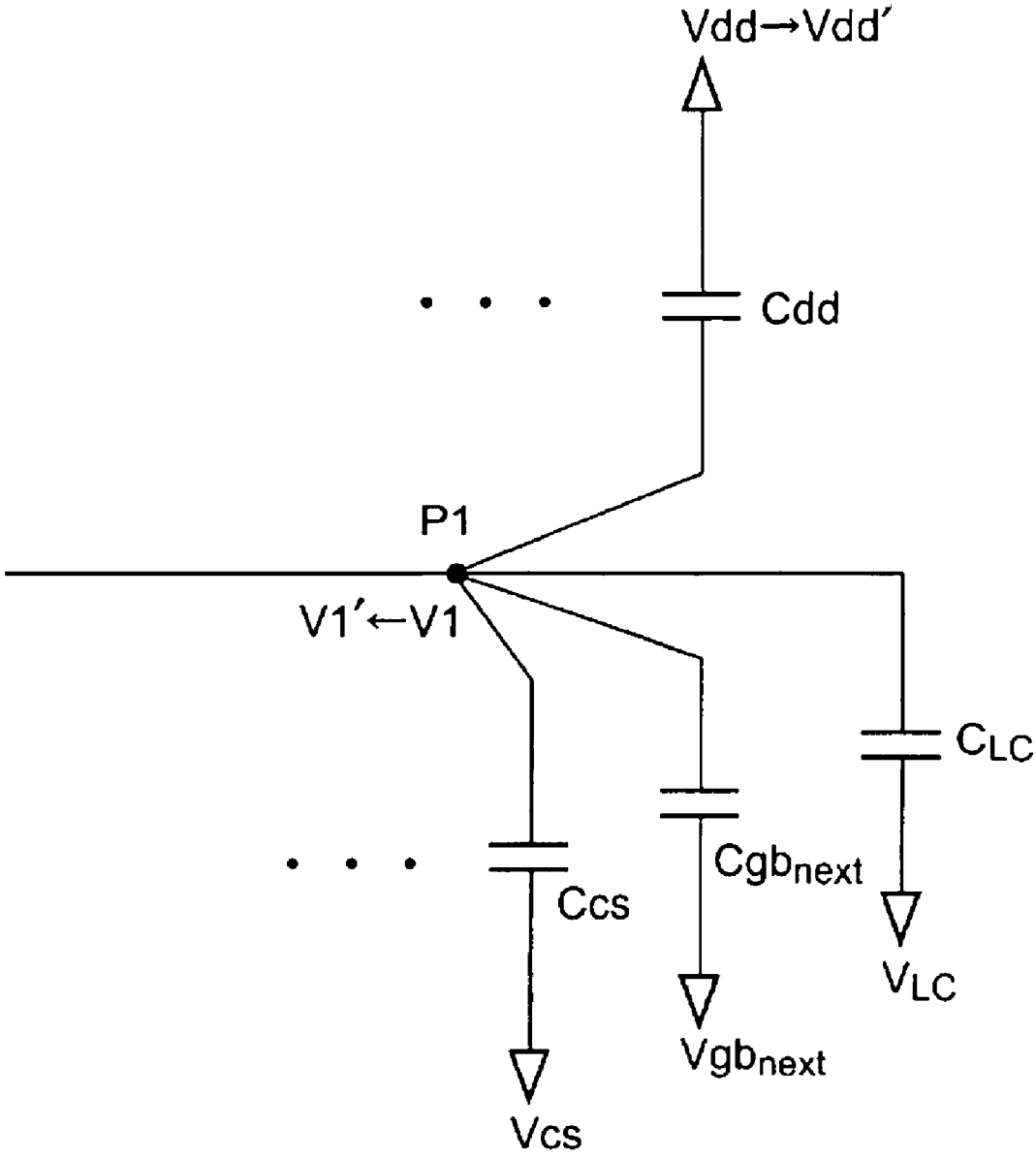

[Fig. 6]
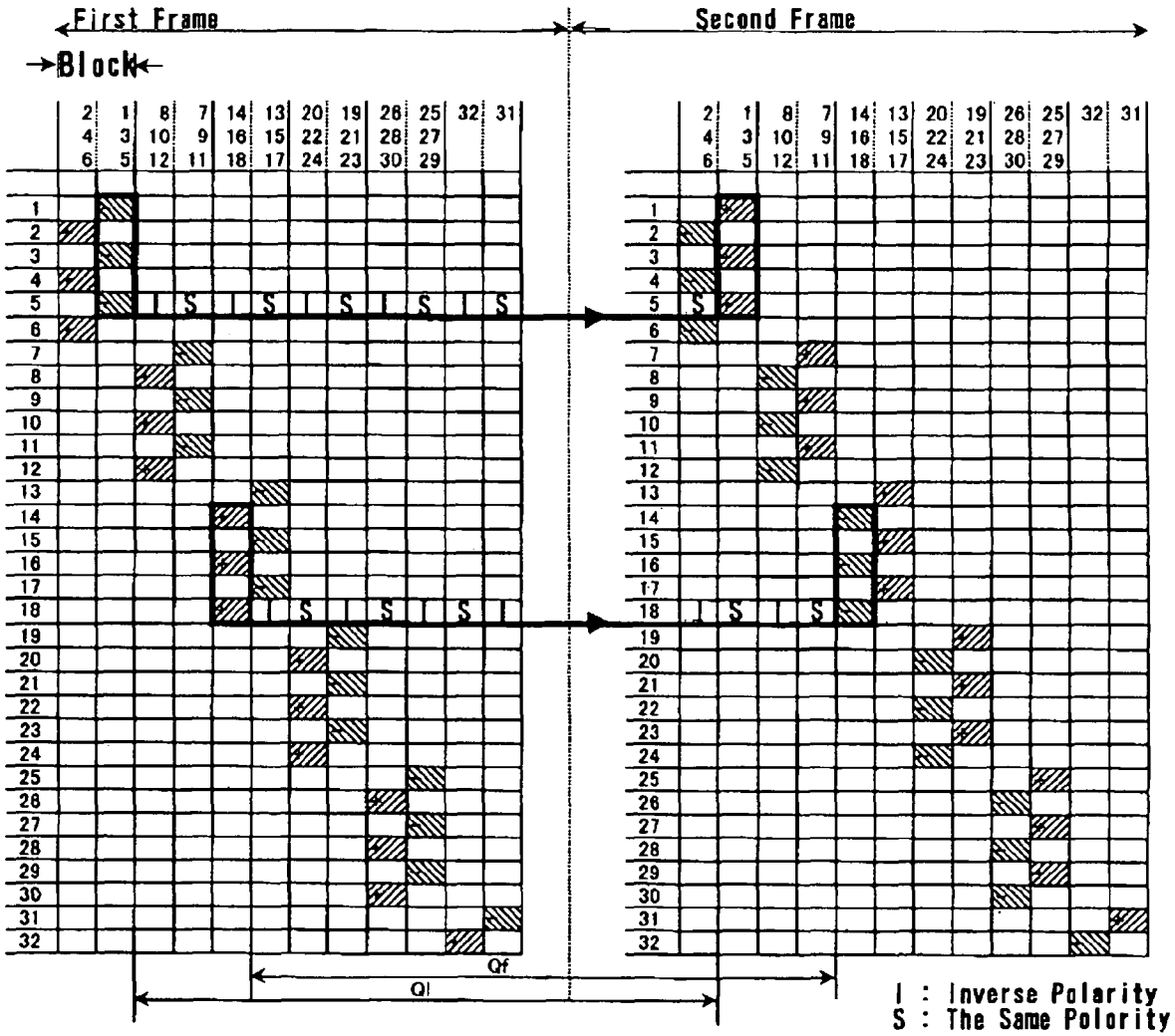

[Fig. 7]
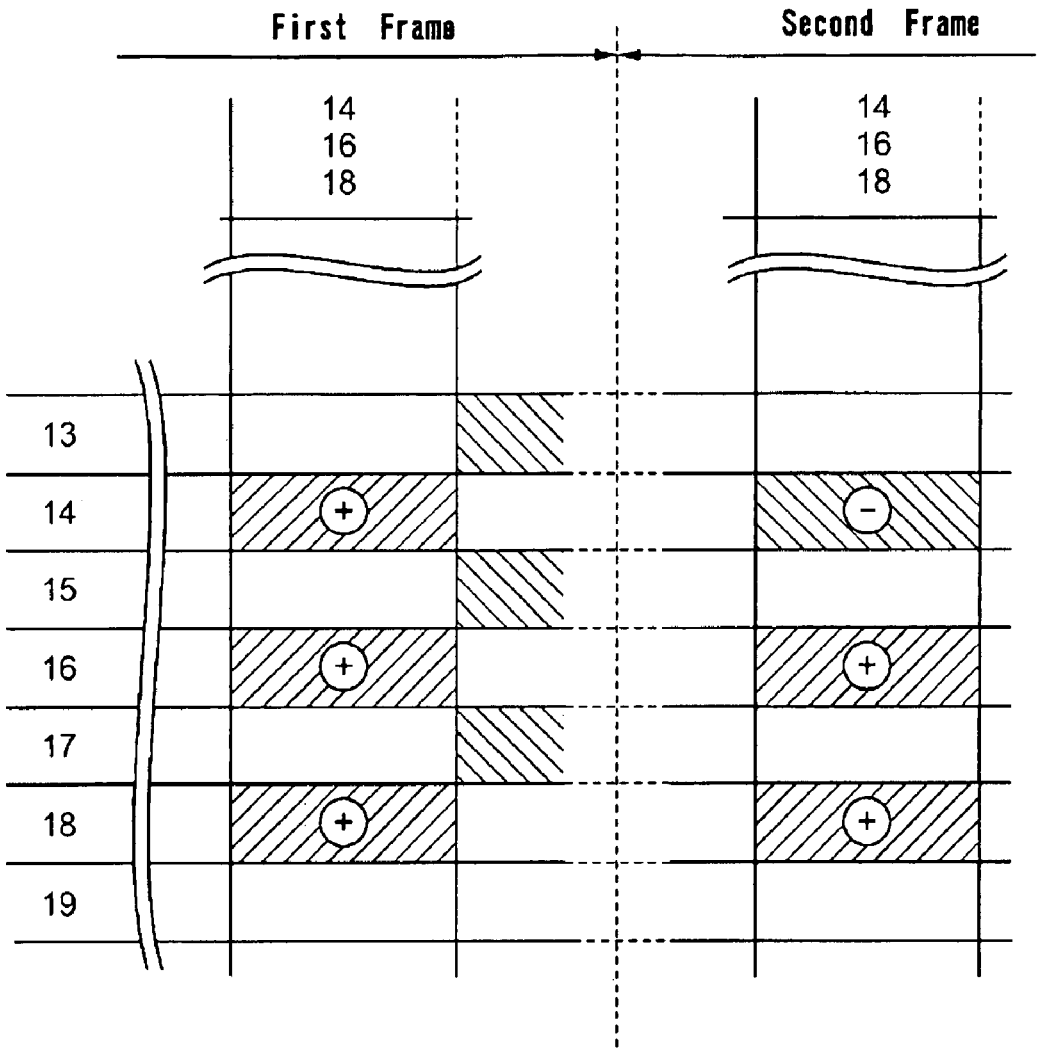

[Fig. 8]
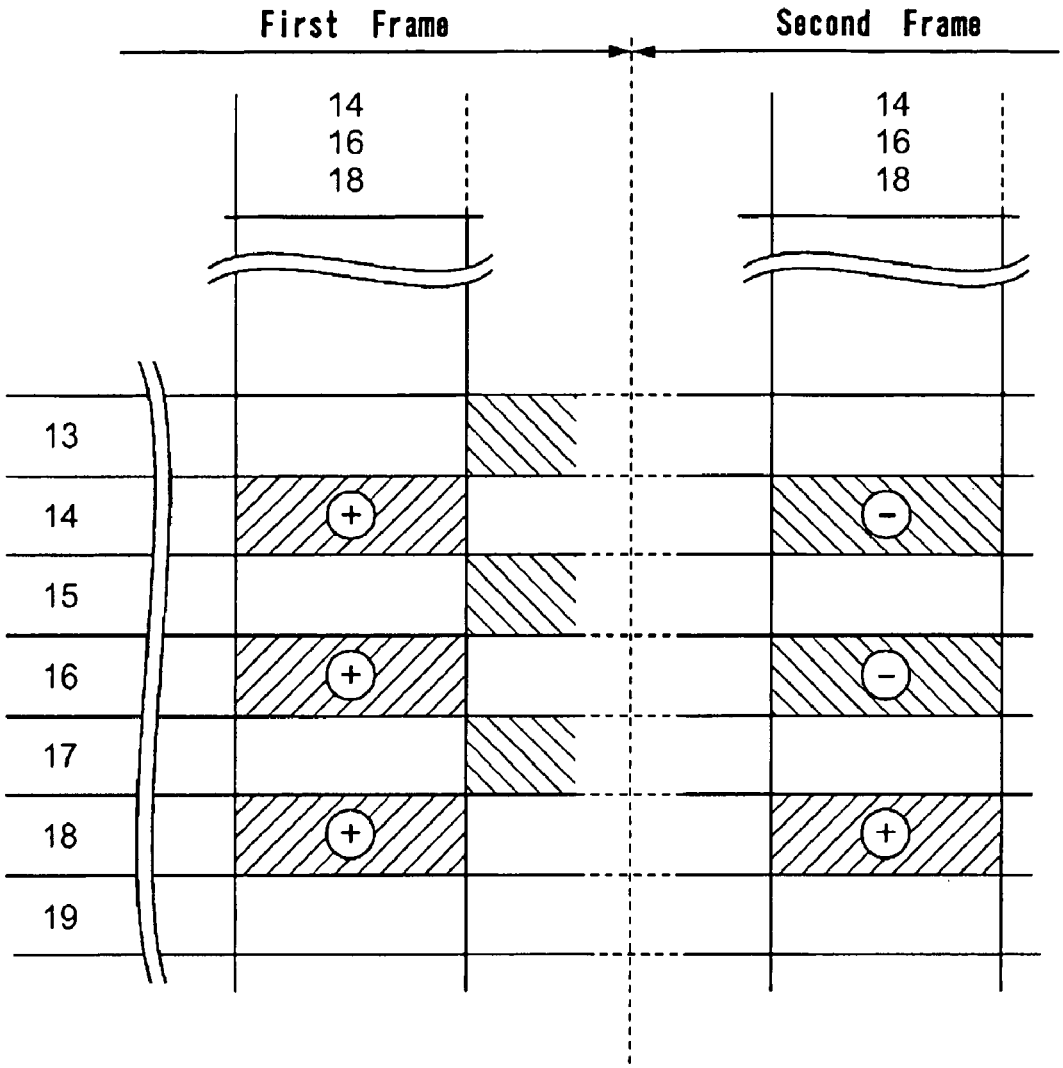

[Fig. 9]
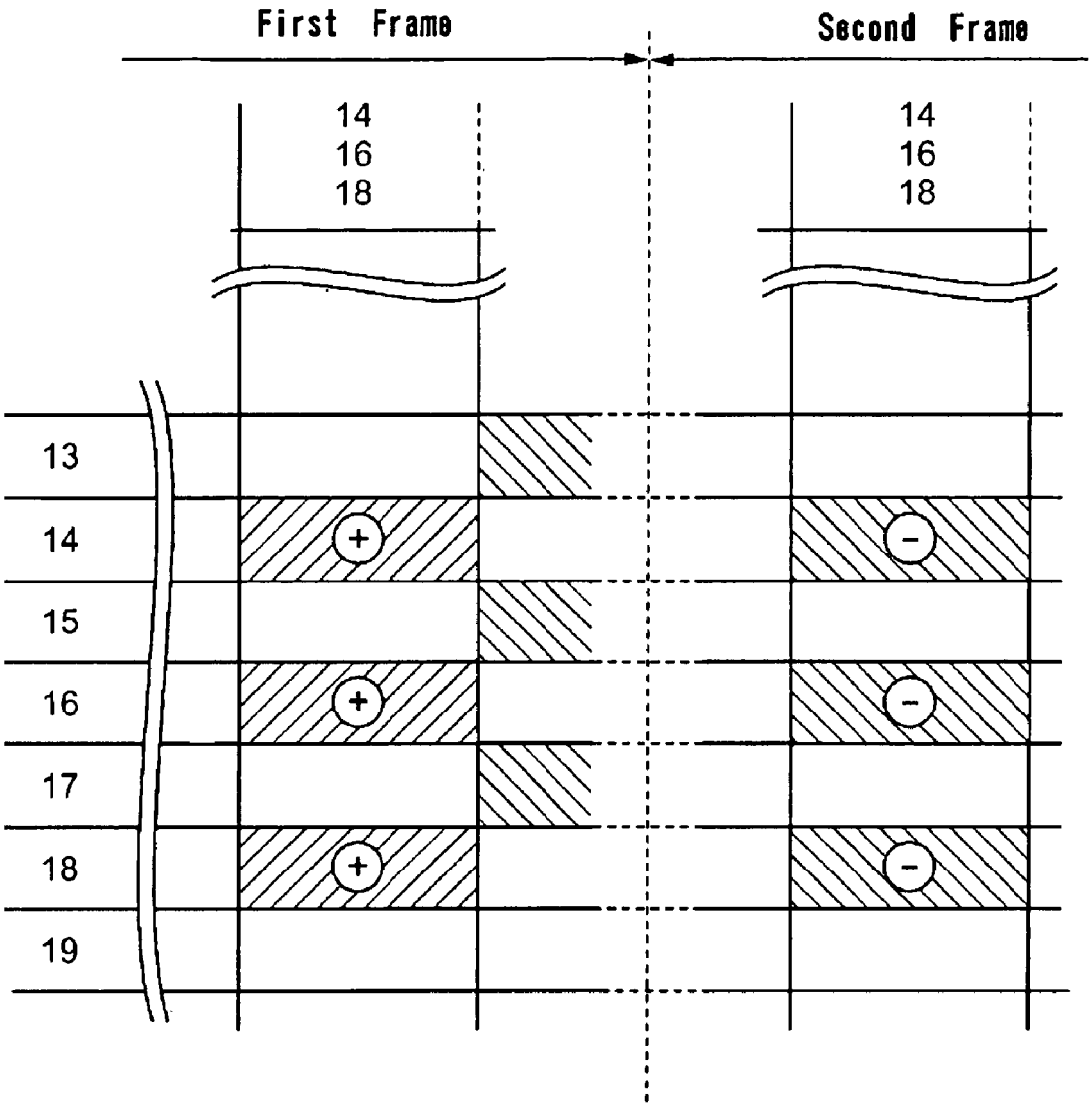

[Fig. 10]
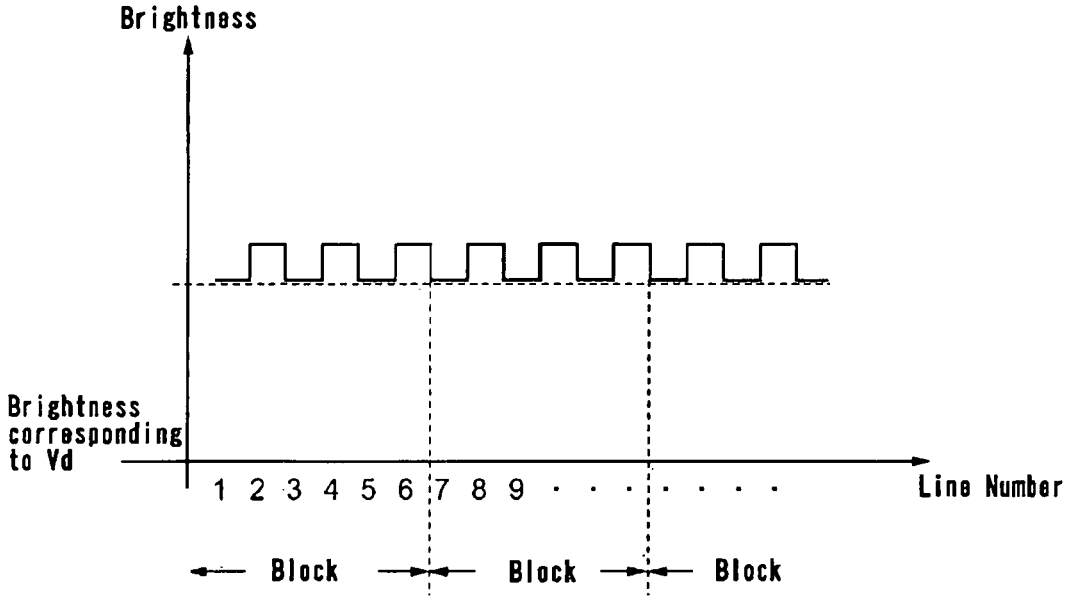
[Fig. 11]
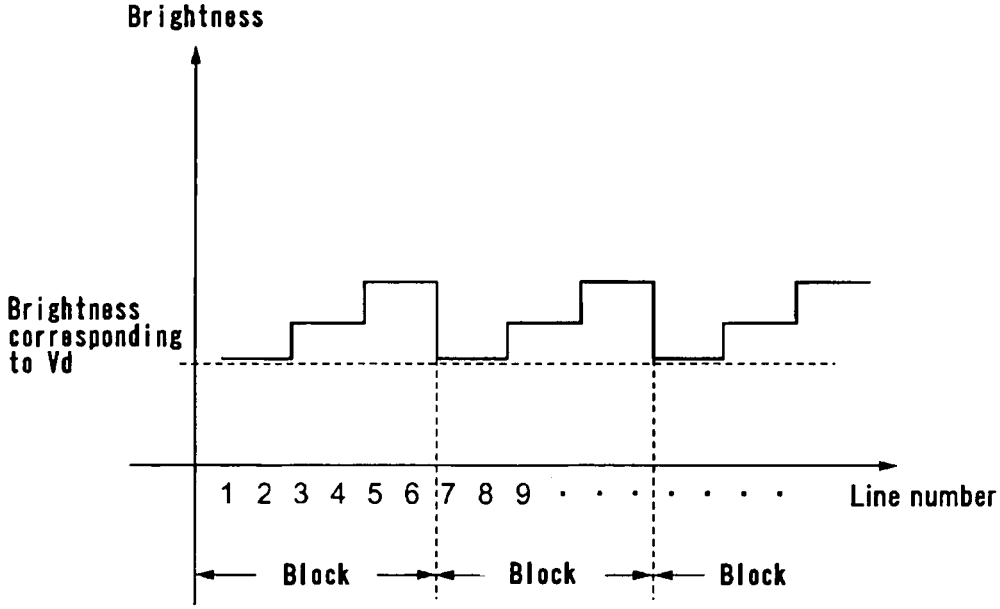

[Fig. 12]
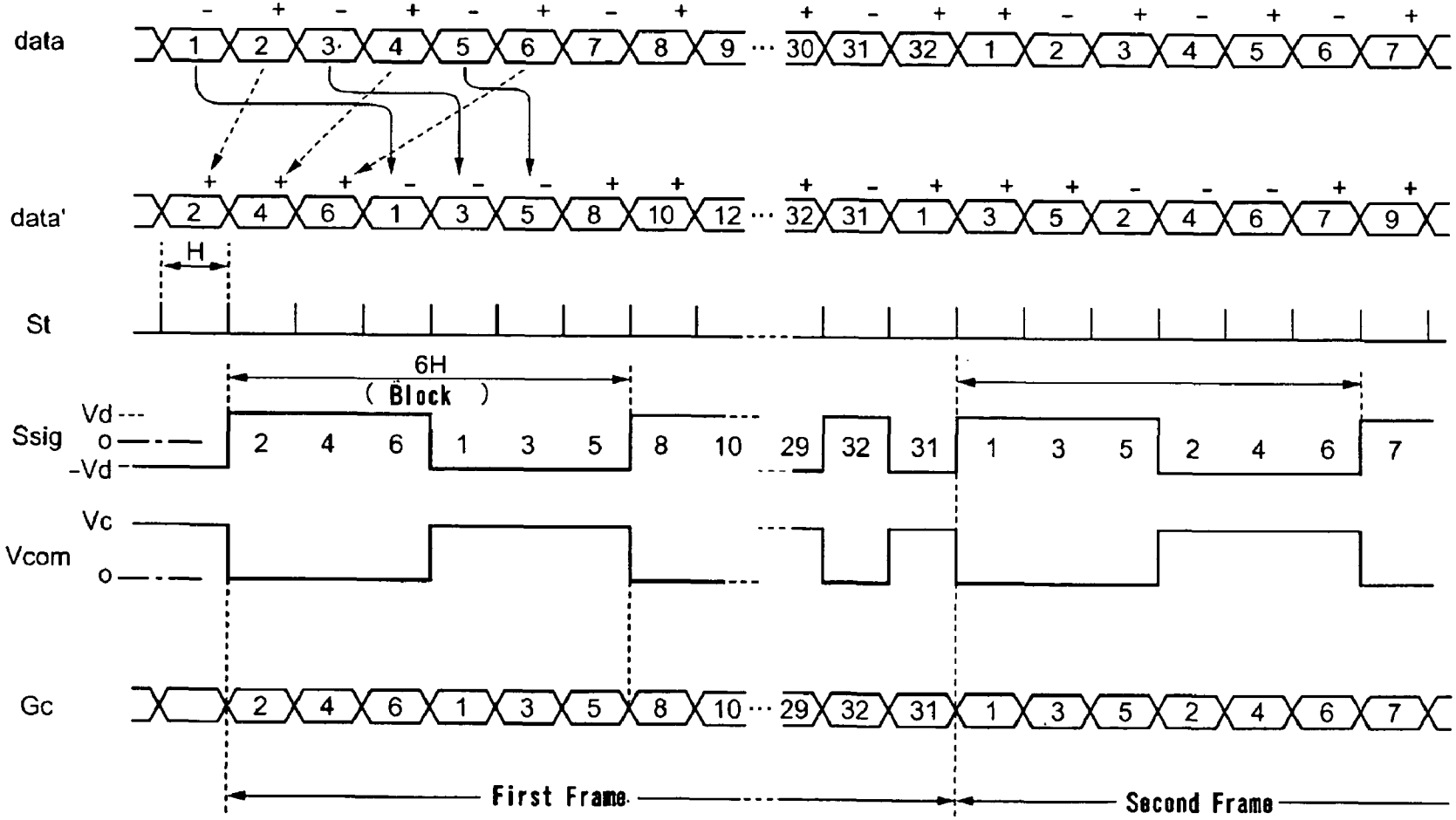

[Fig. 13]
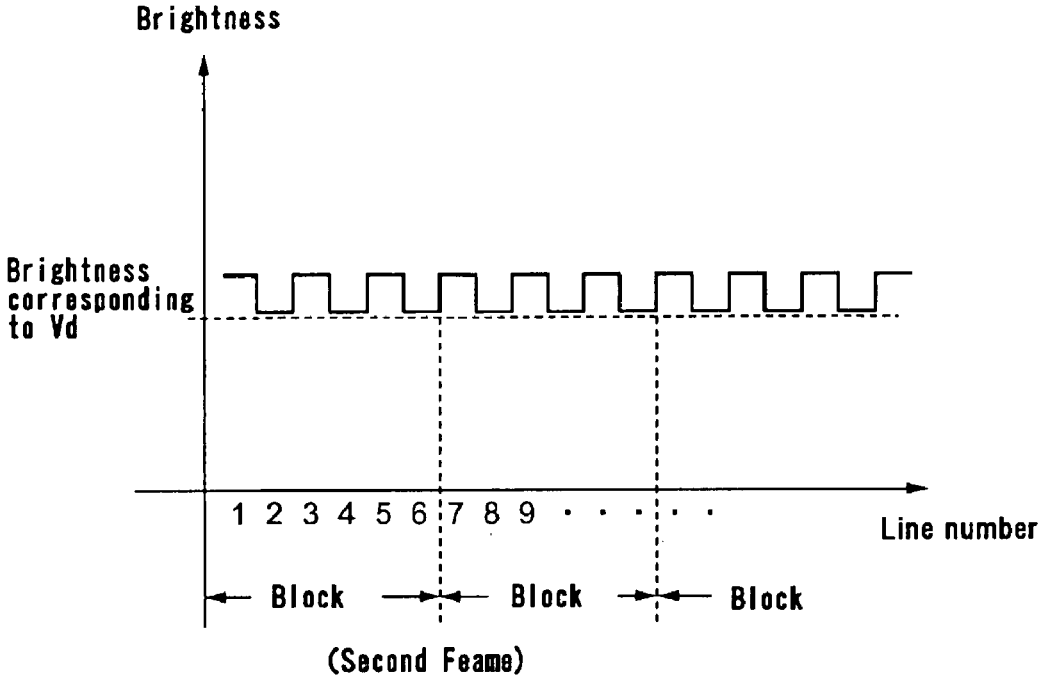

[Fig. 14]
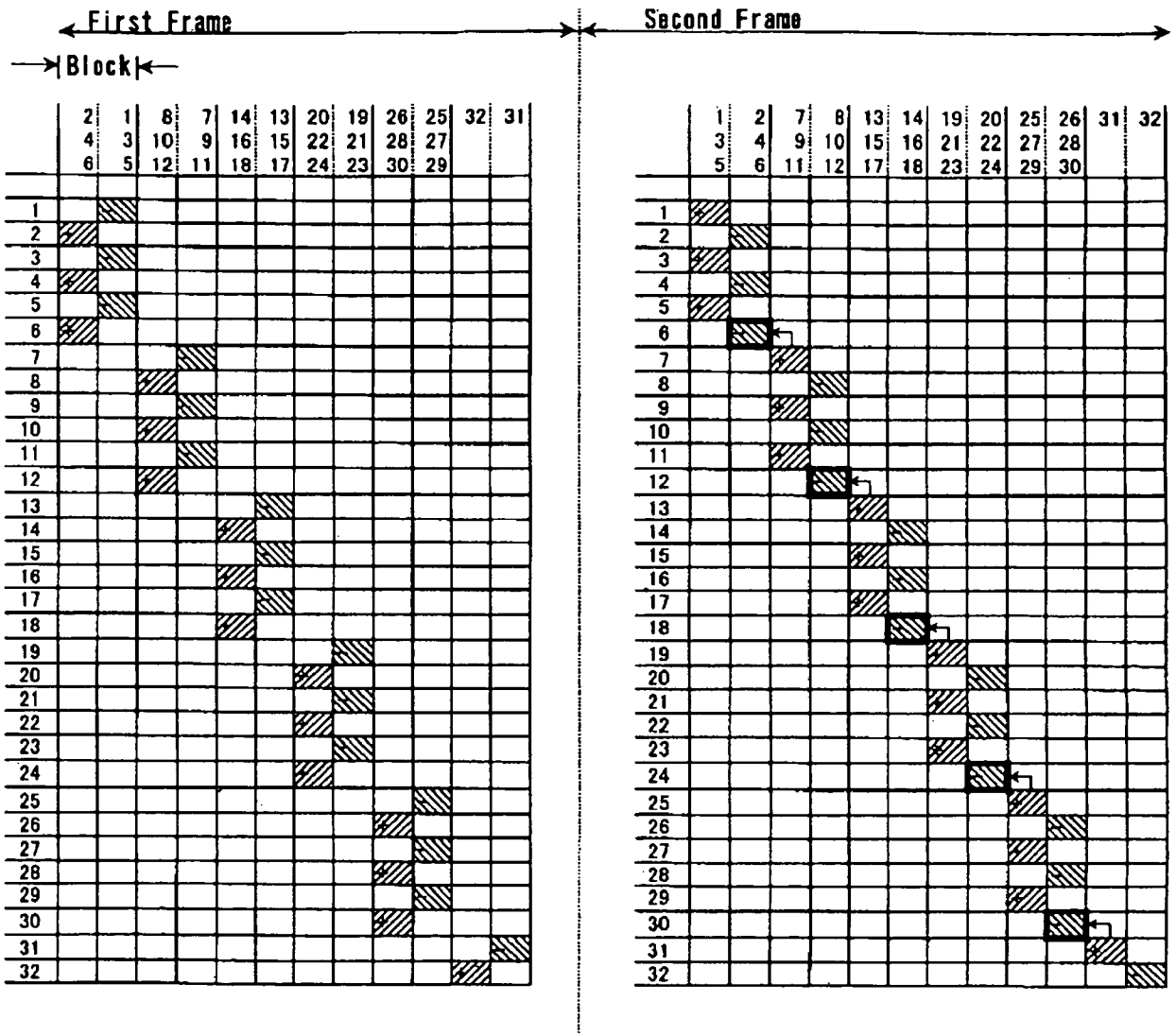

[Fig. 15]
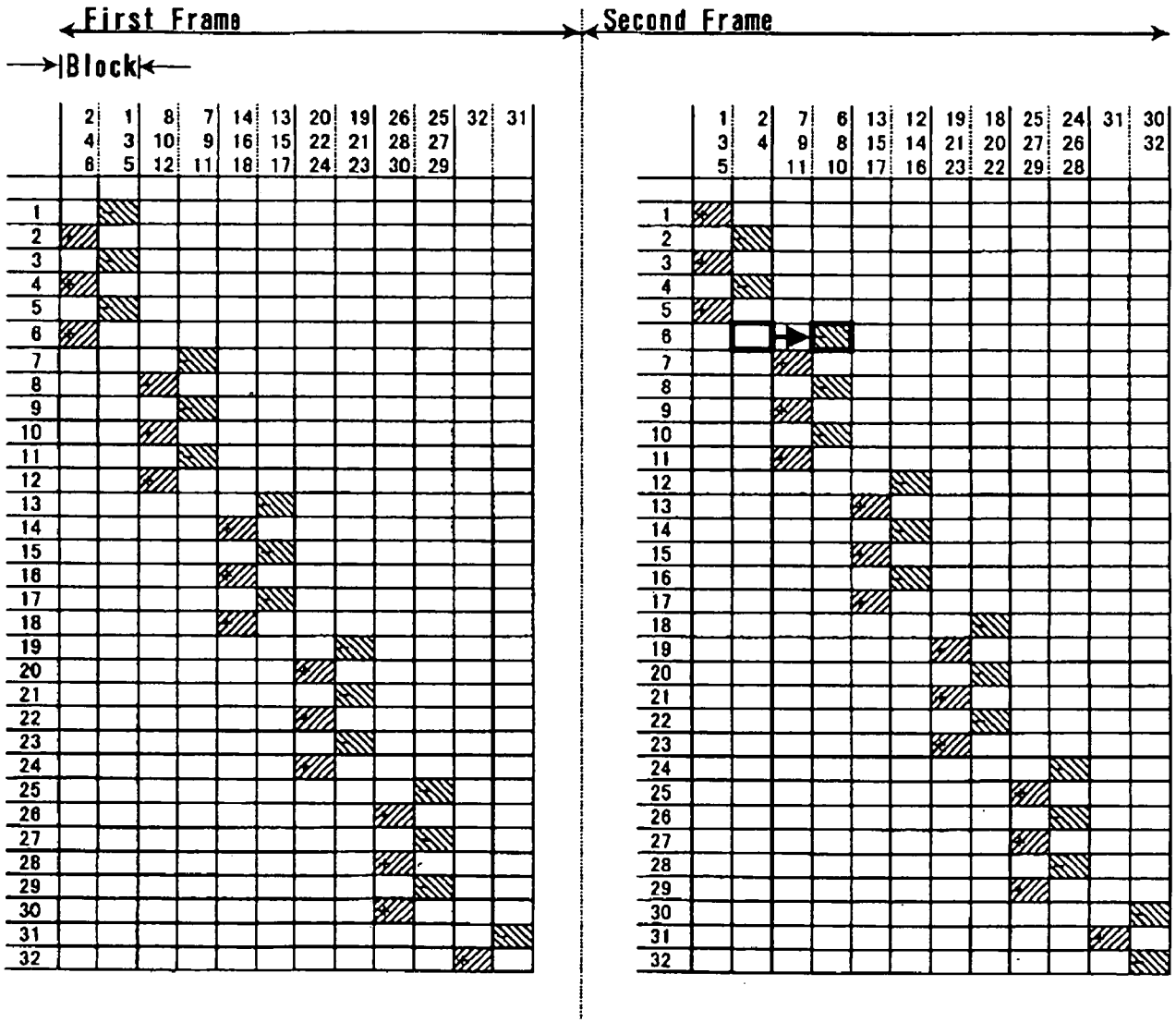

[Fig. 16]
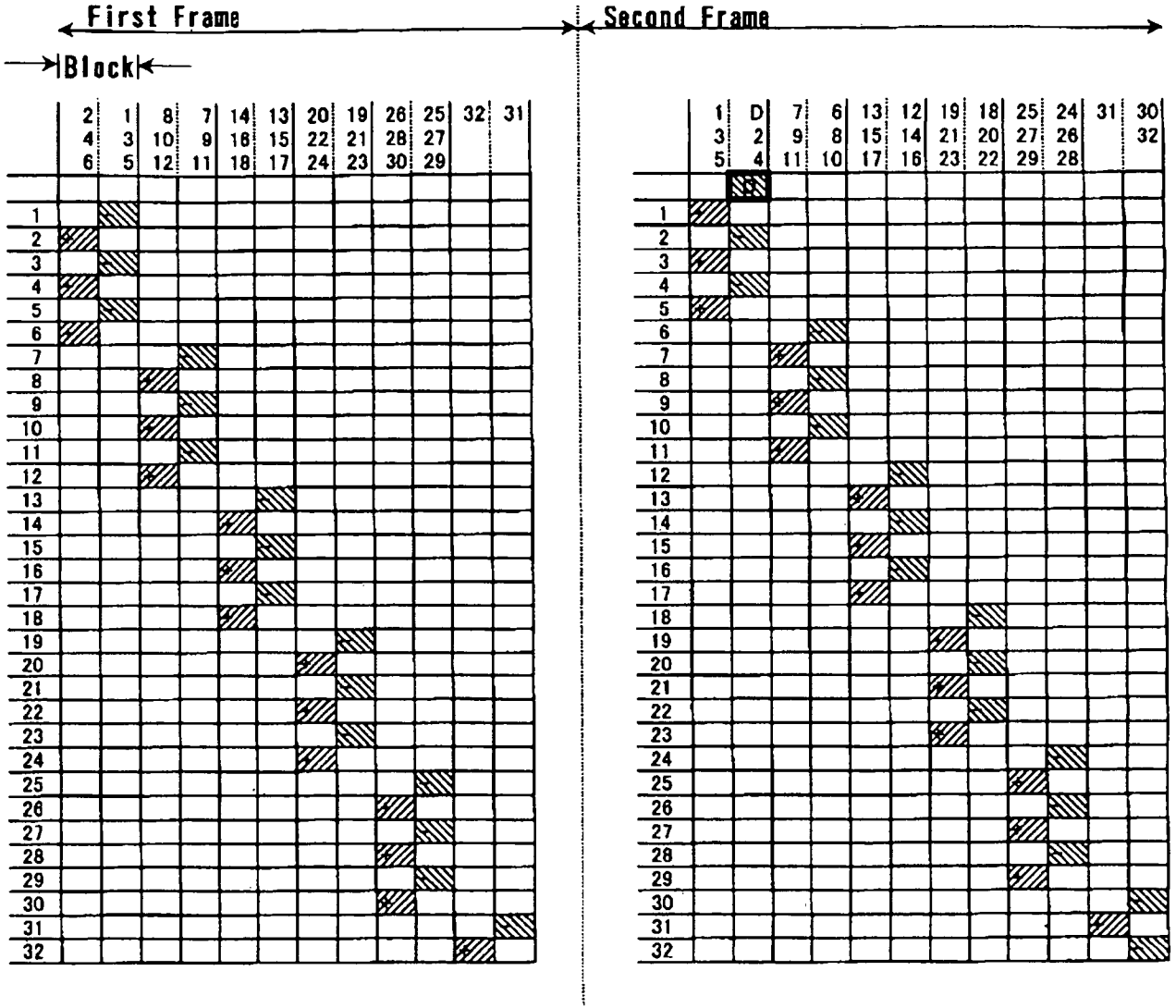

[Fig. 17]
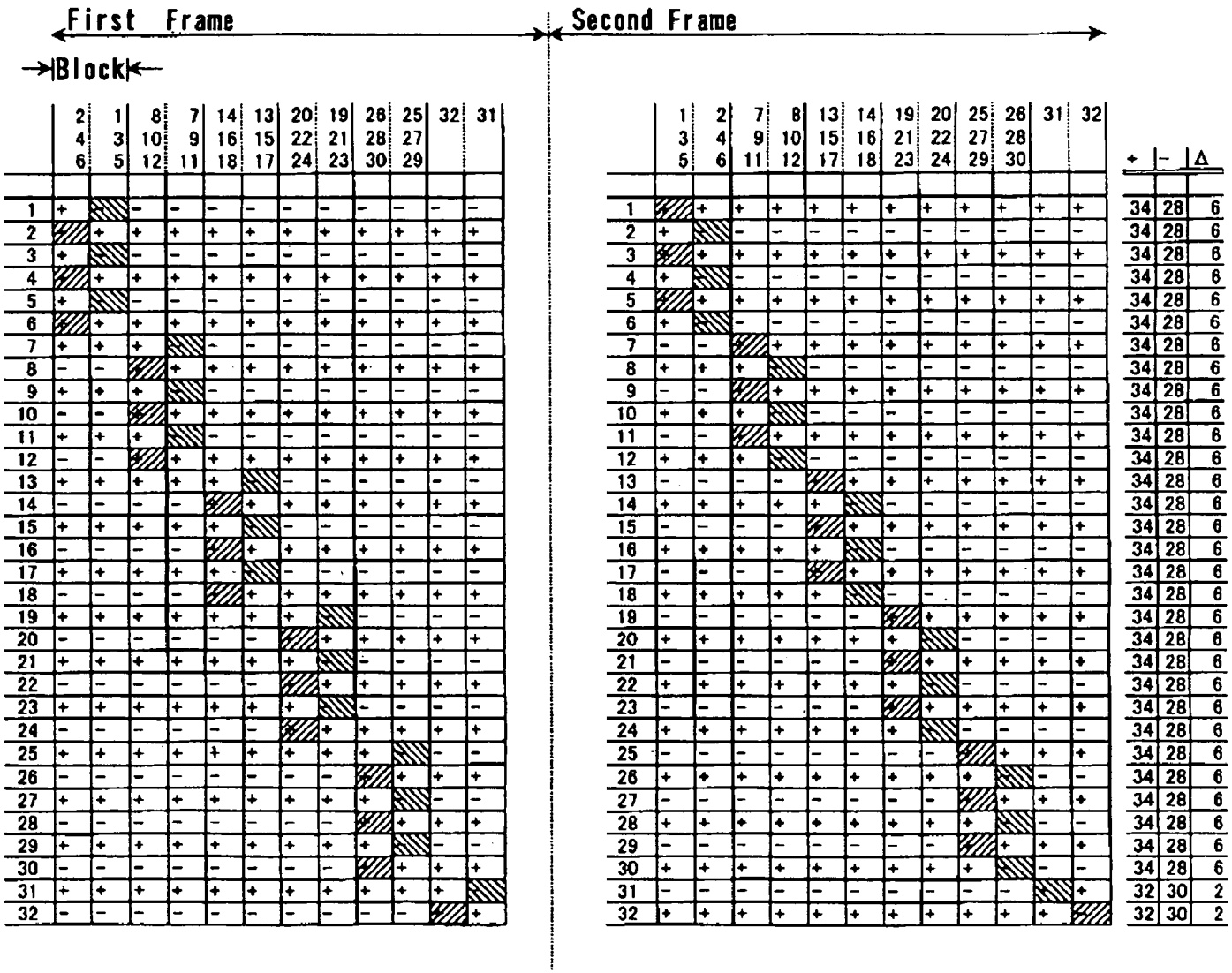

[Fig. 18]
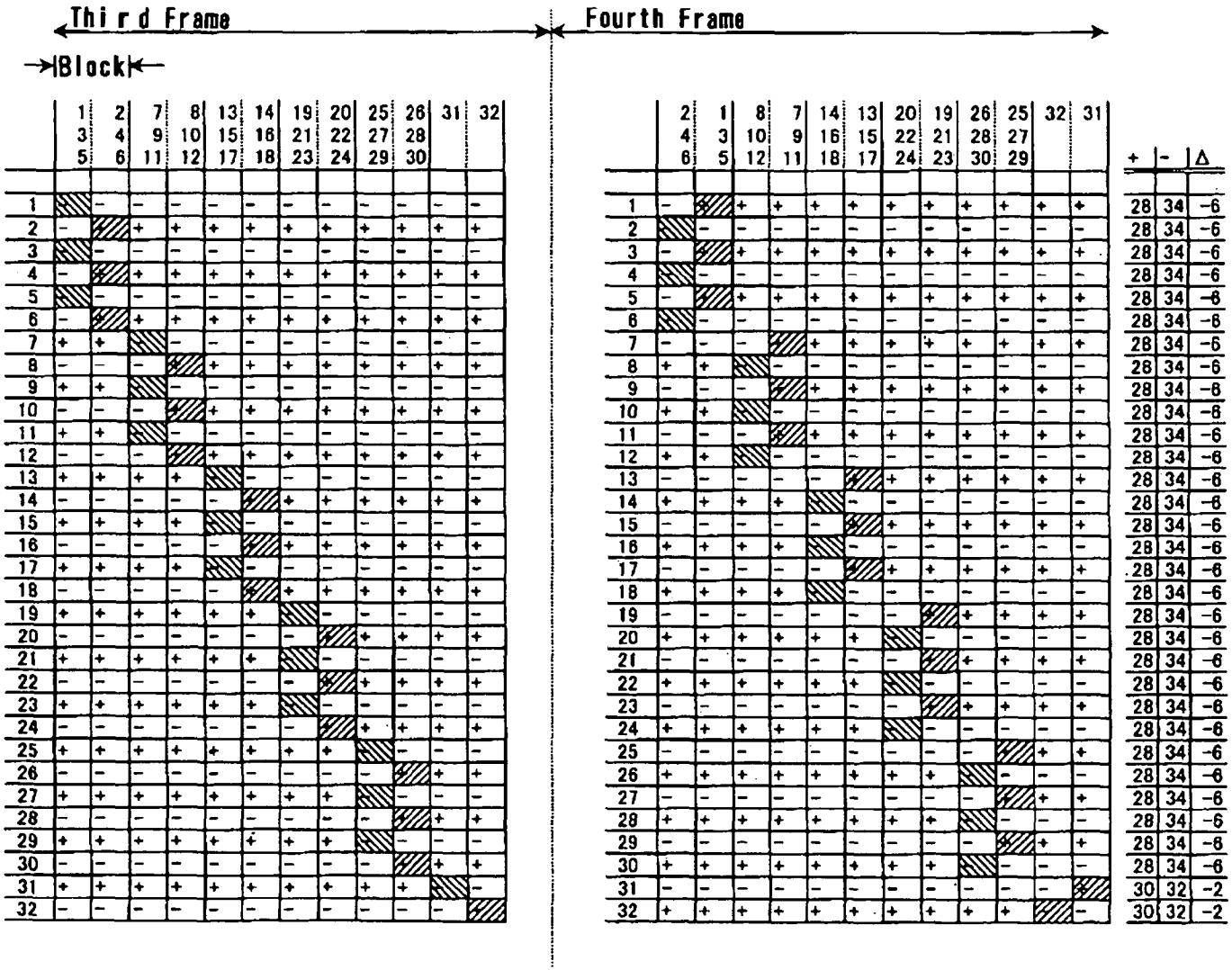

[Fig. 19]
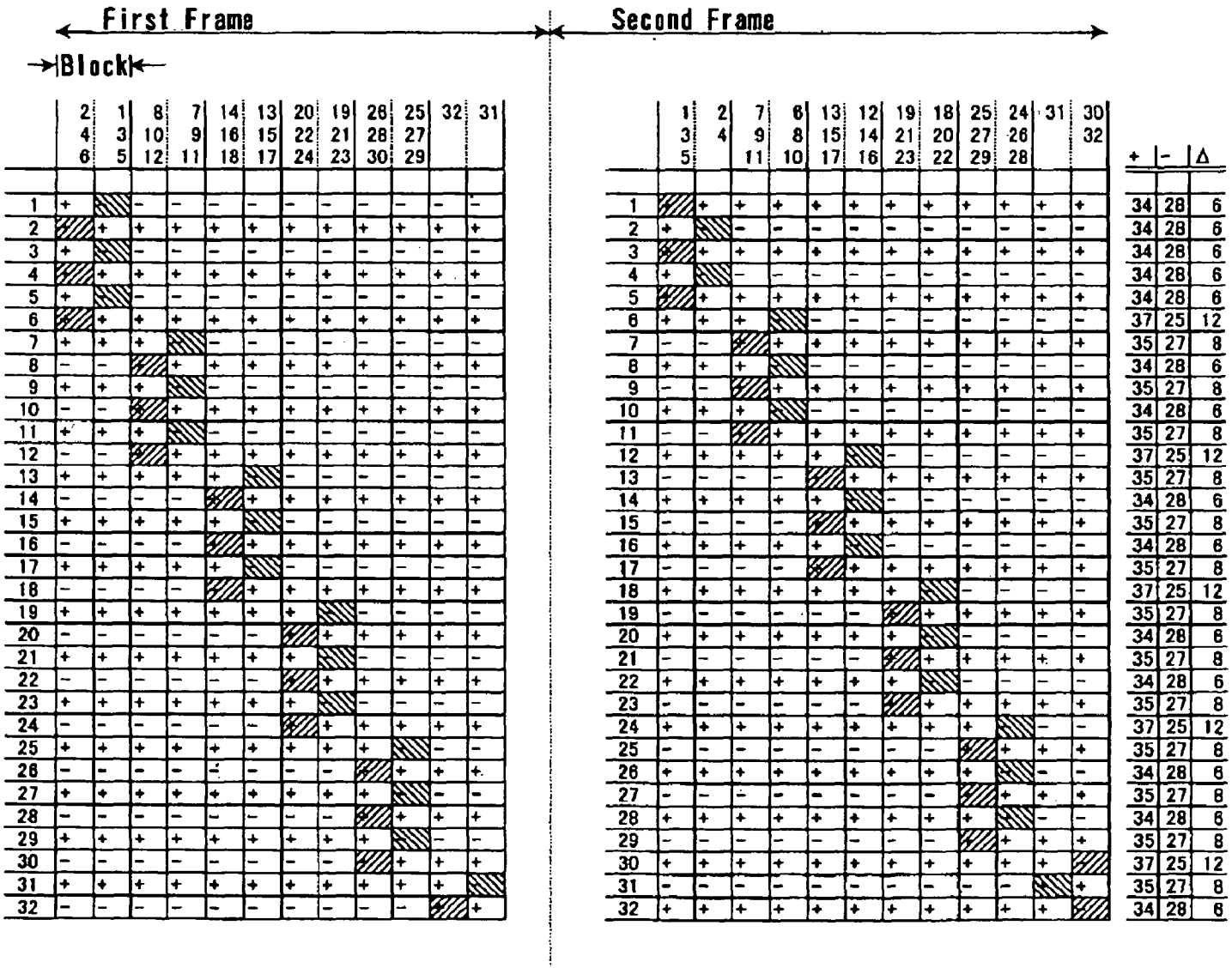

[Fig. 20]
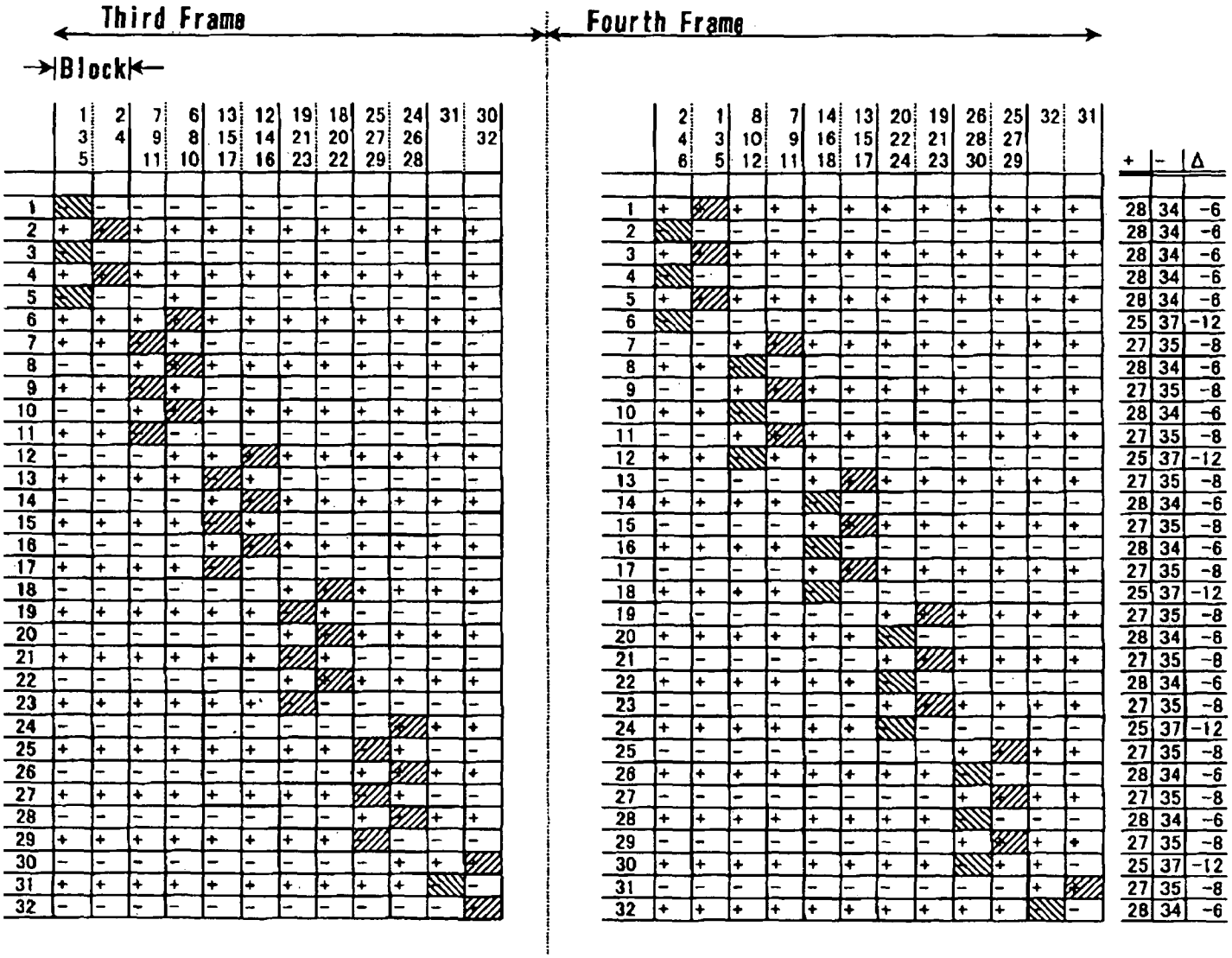

[Fig. 21]
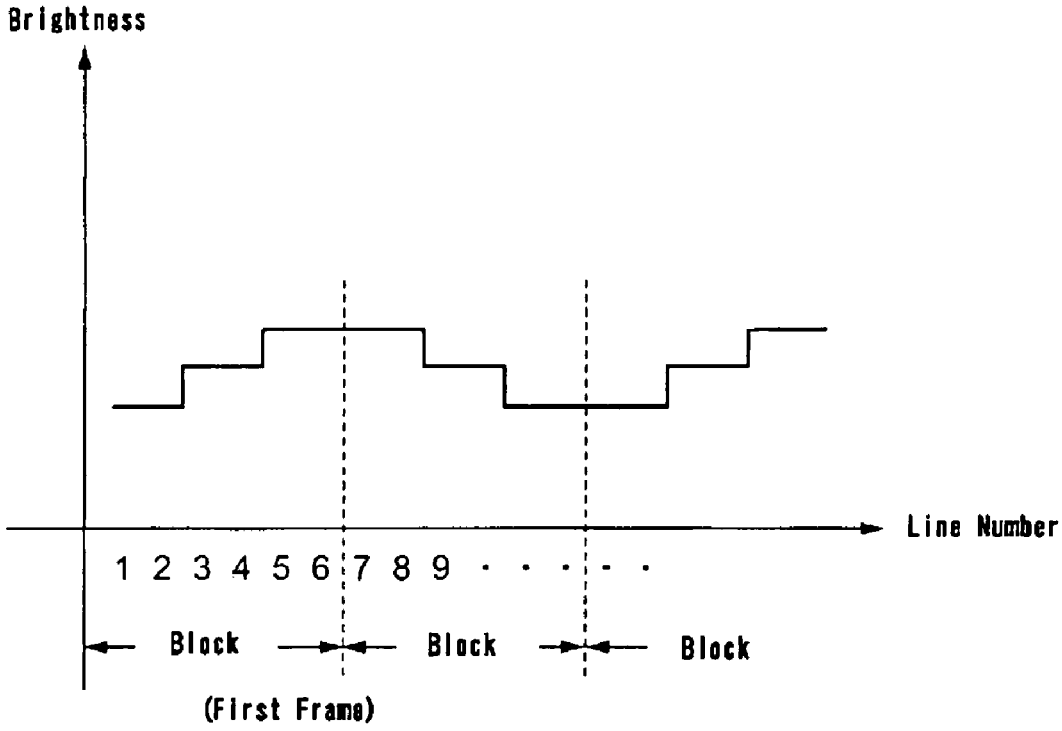

[Fig. 22]
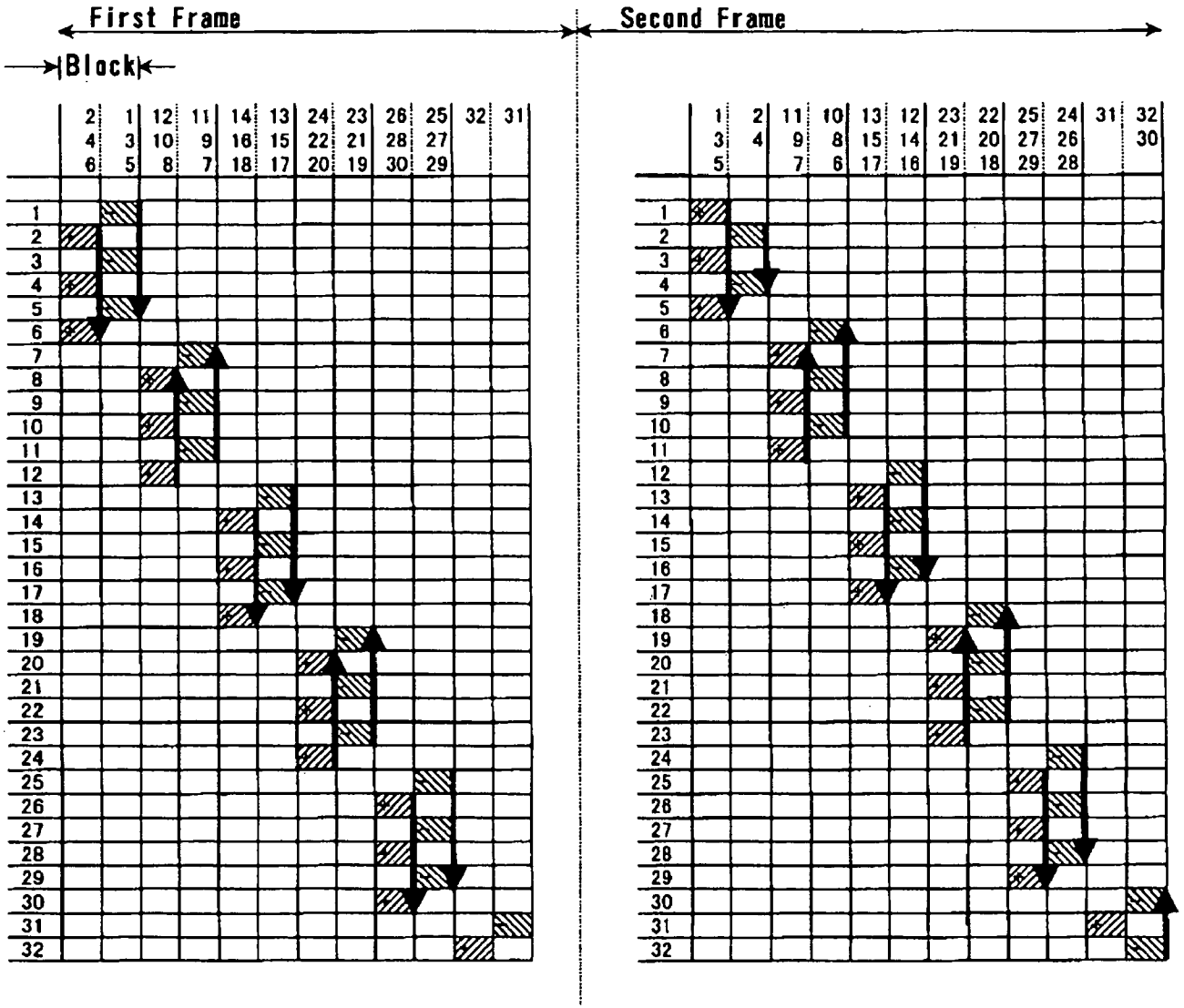

[Fig. 23]
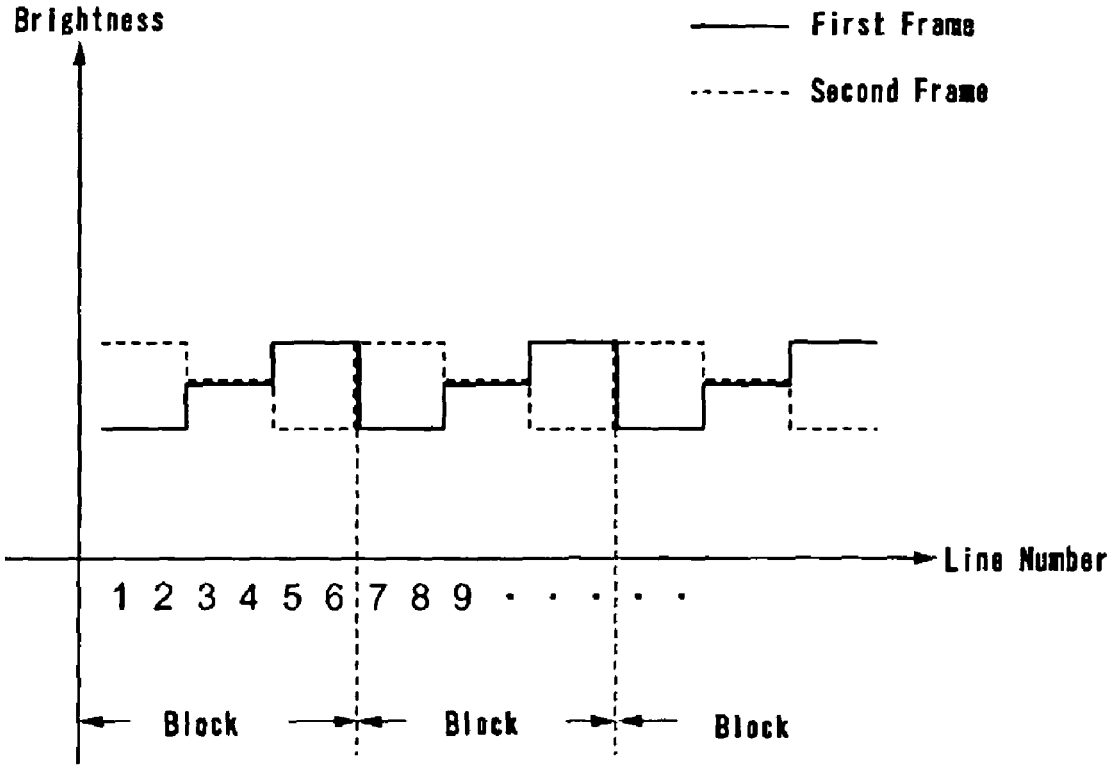

[Fig. 24]
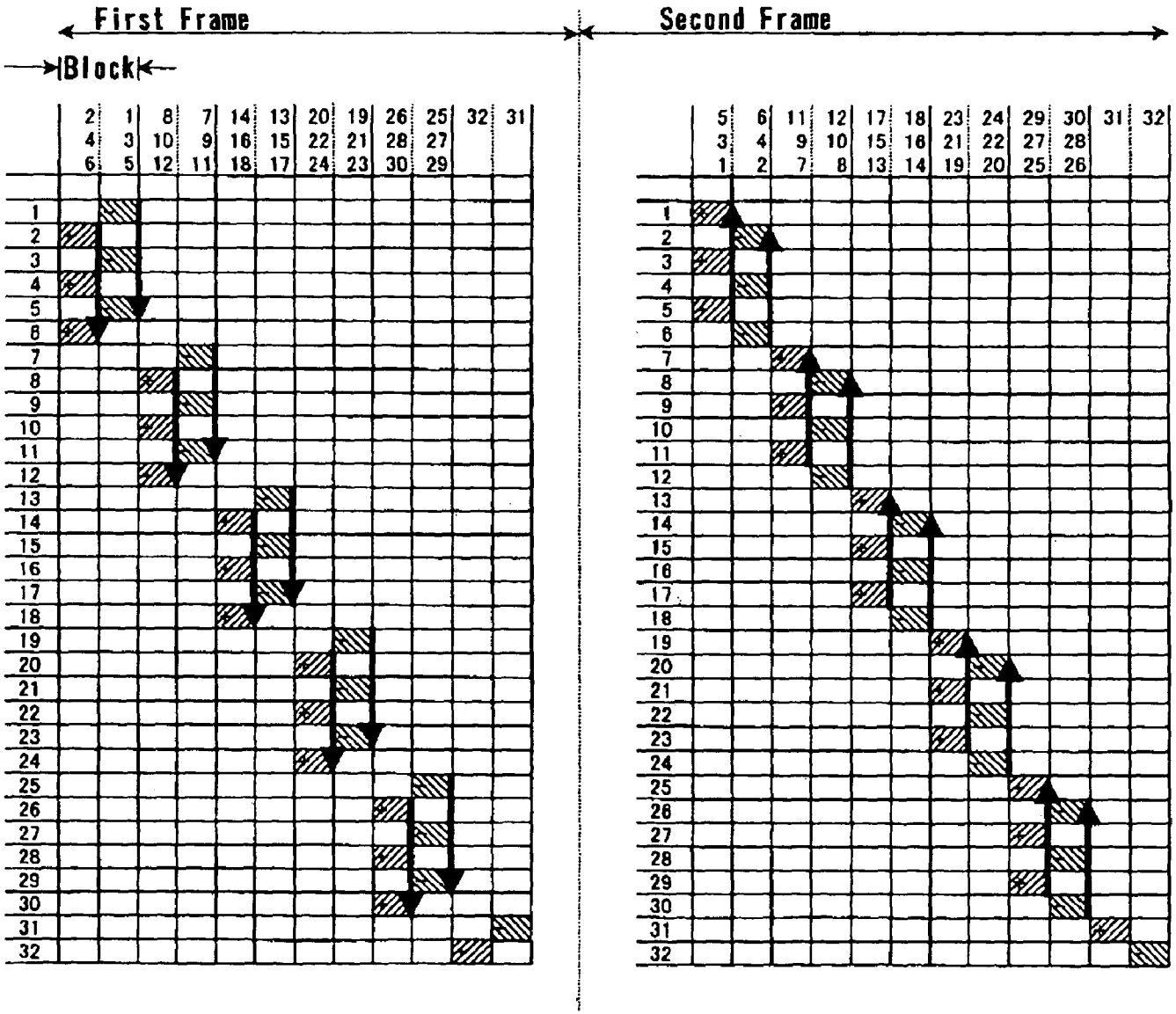

[Fig. 25]
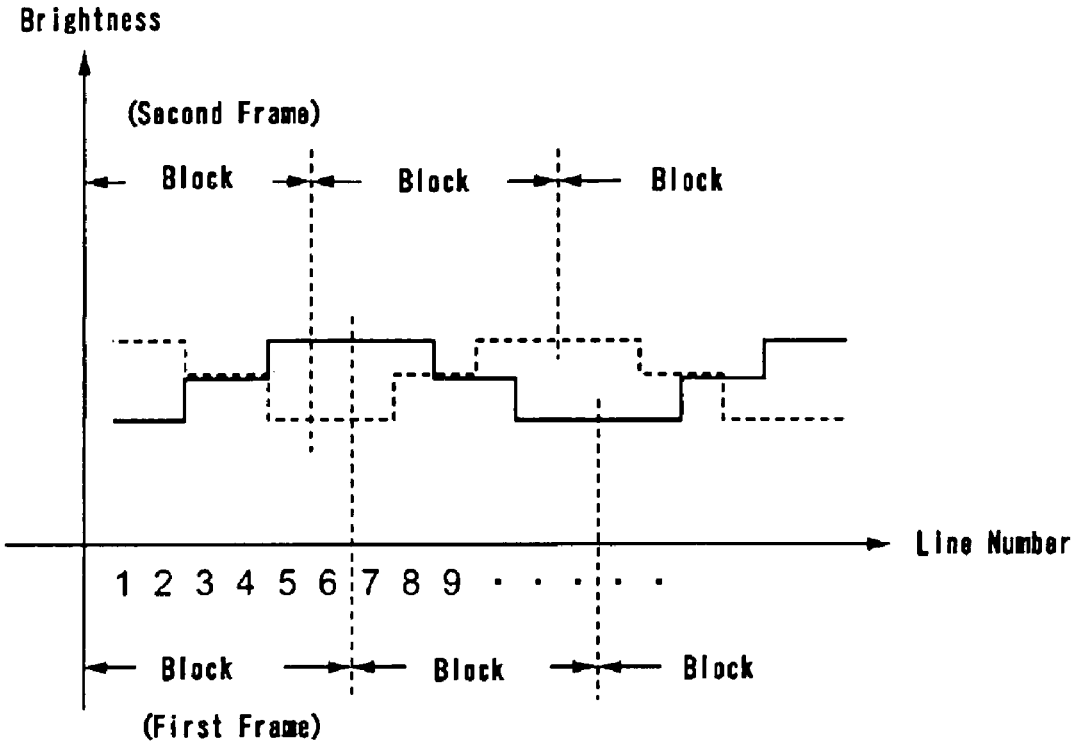

[Fig. 26]
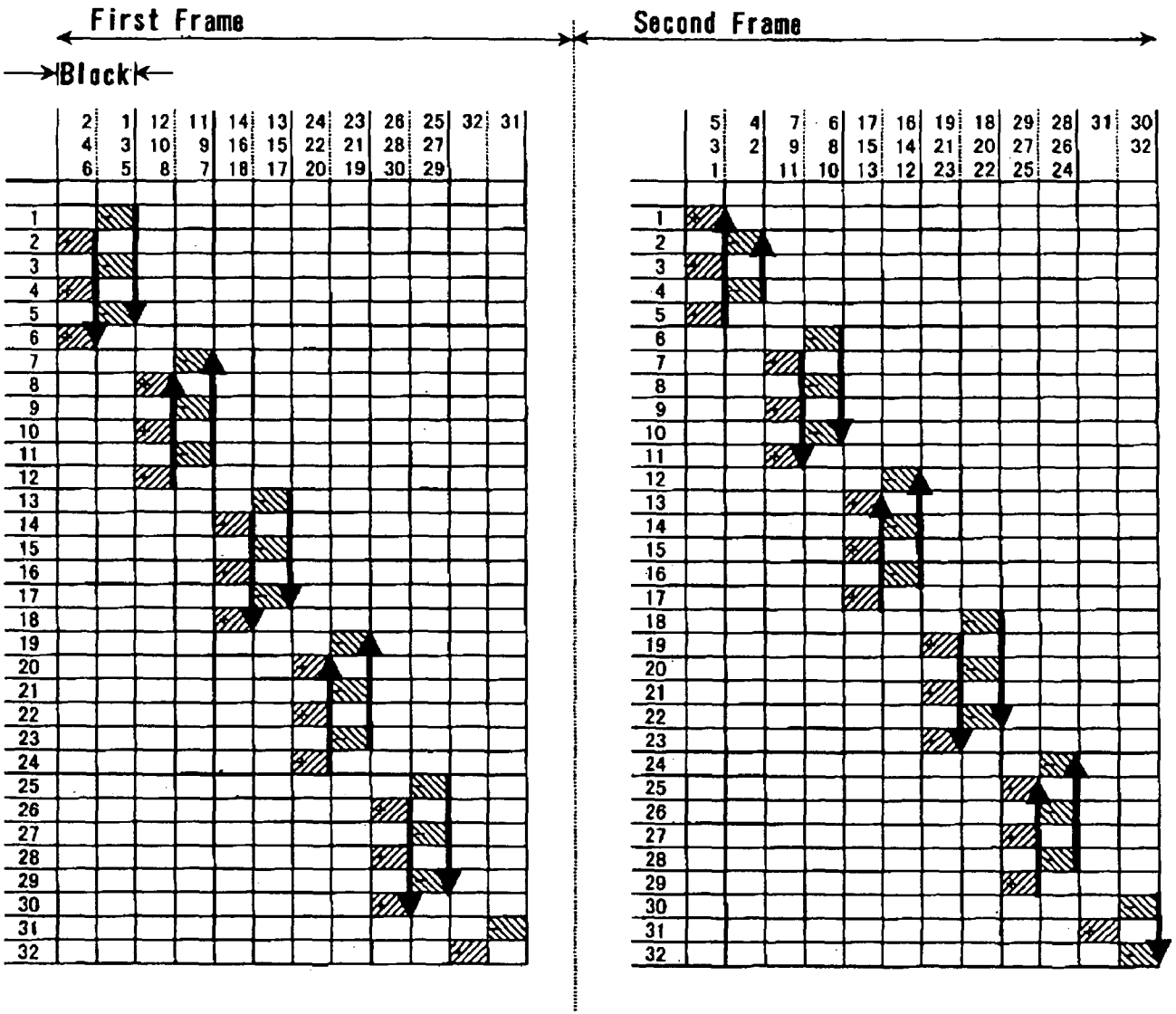

[Fig. 27]
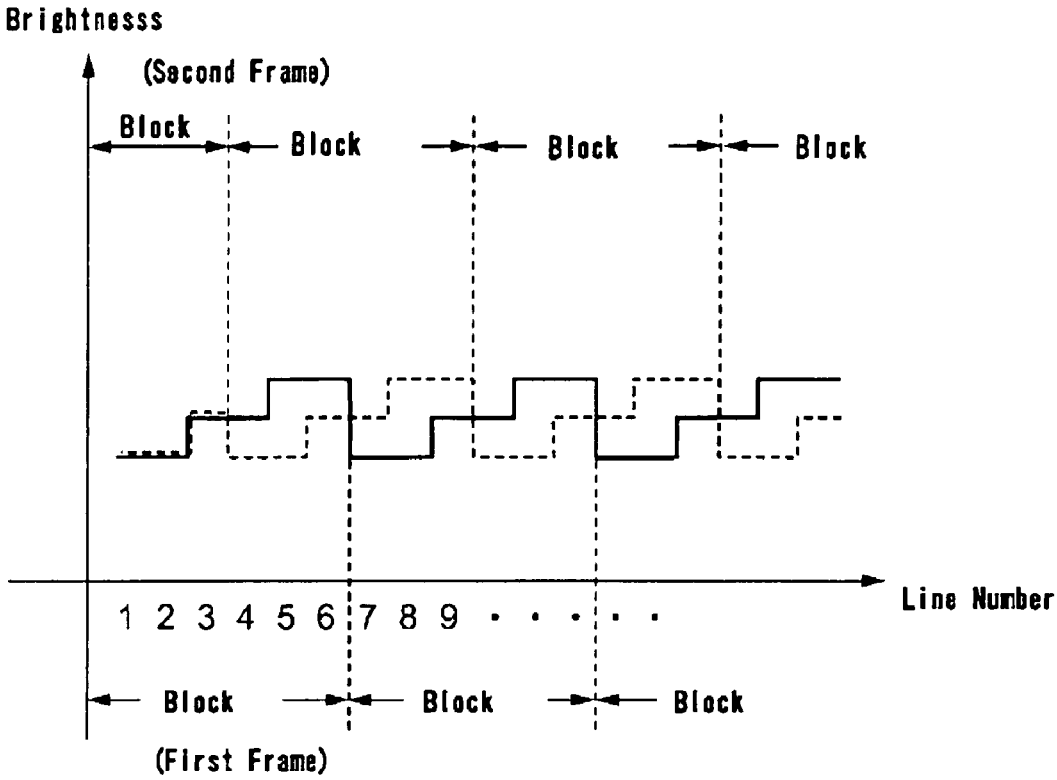

[Fig. 28]
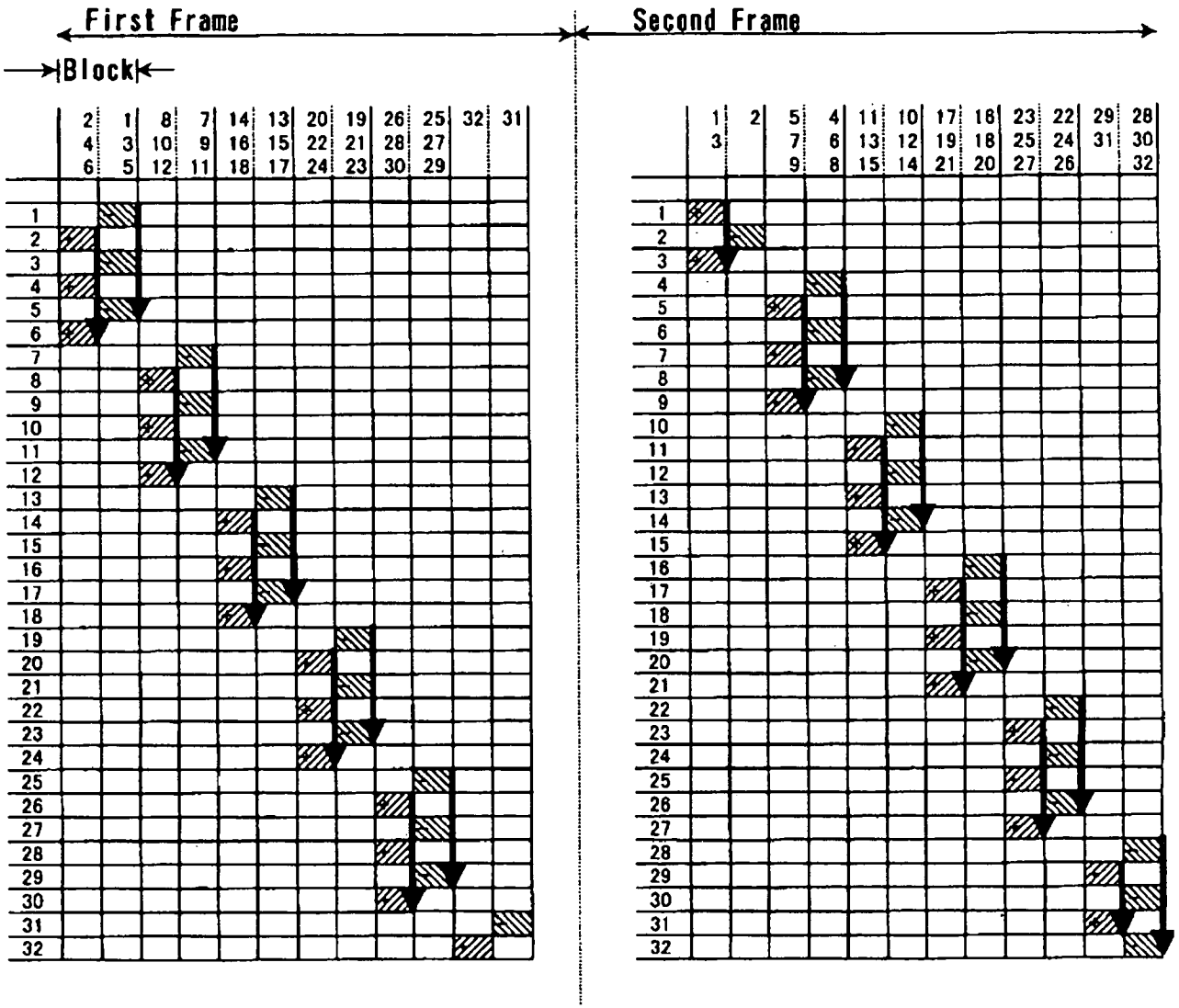

[Fig. 29]
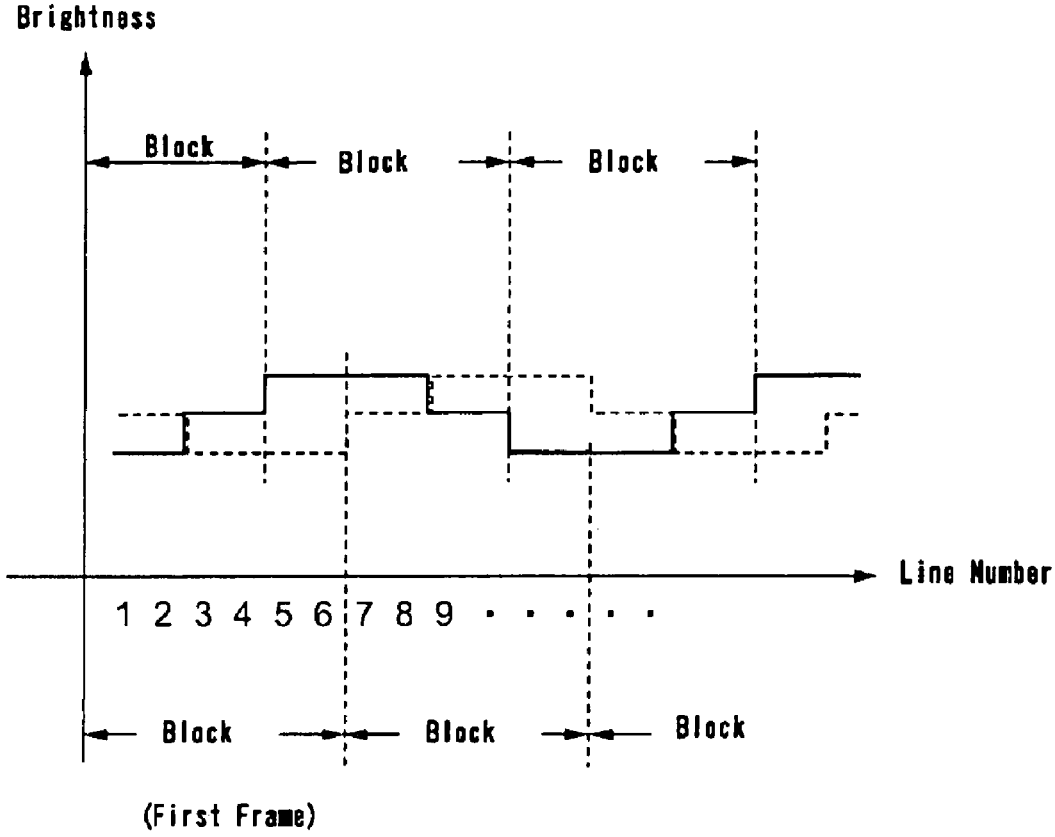

[Fig. 30]
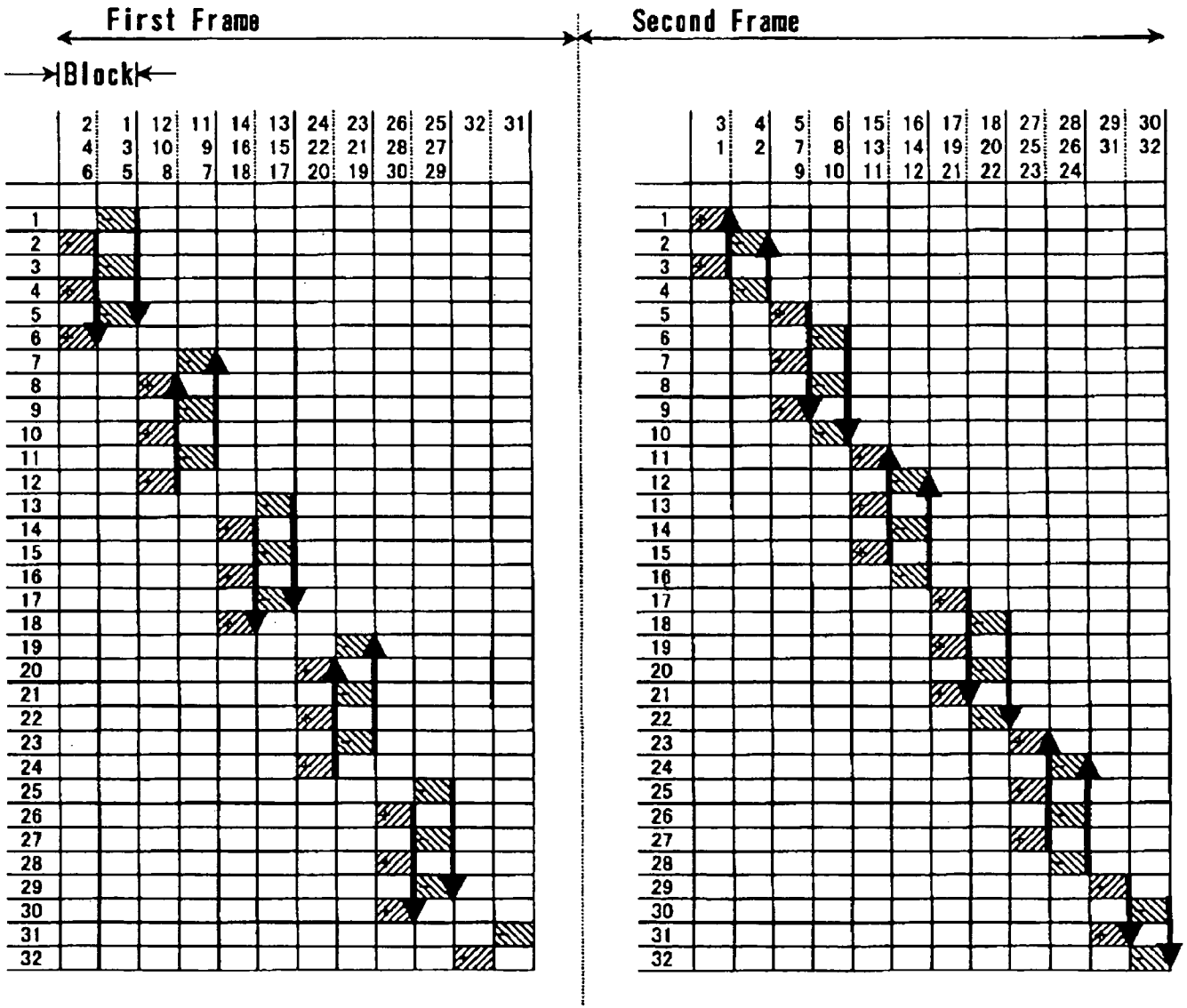

[Fig. 31]
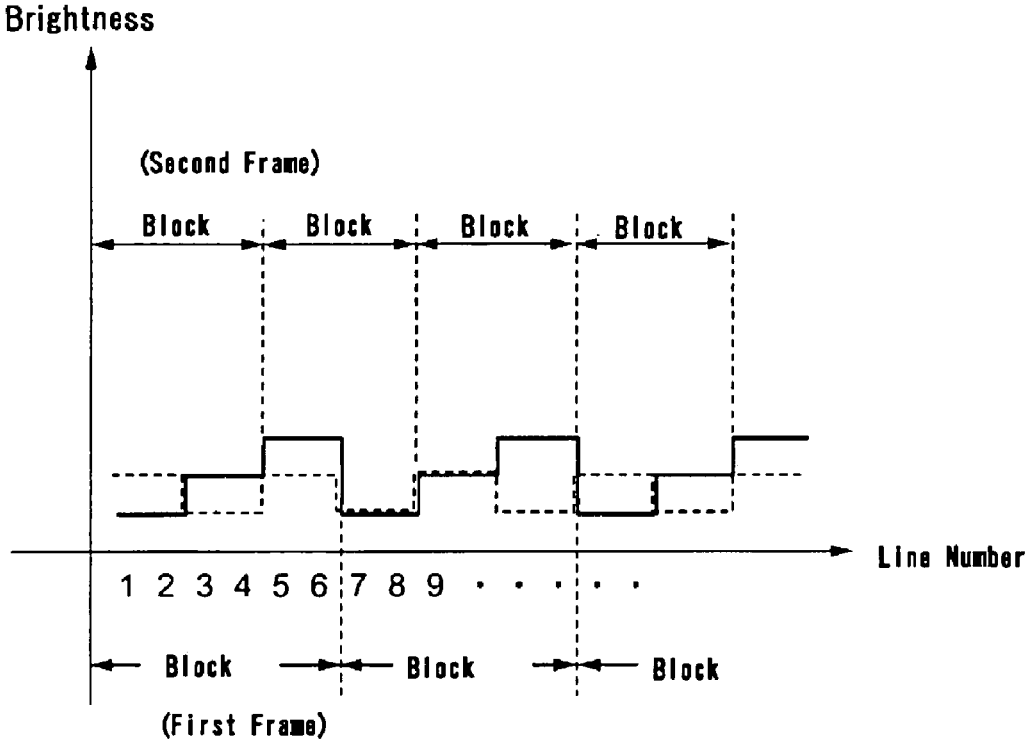

[Fig. 32]
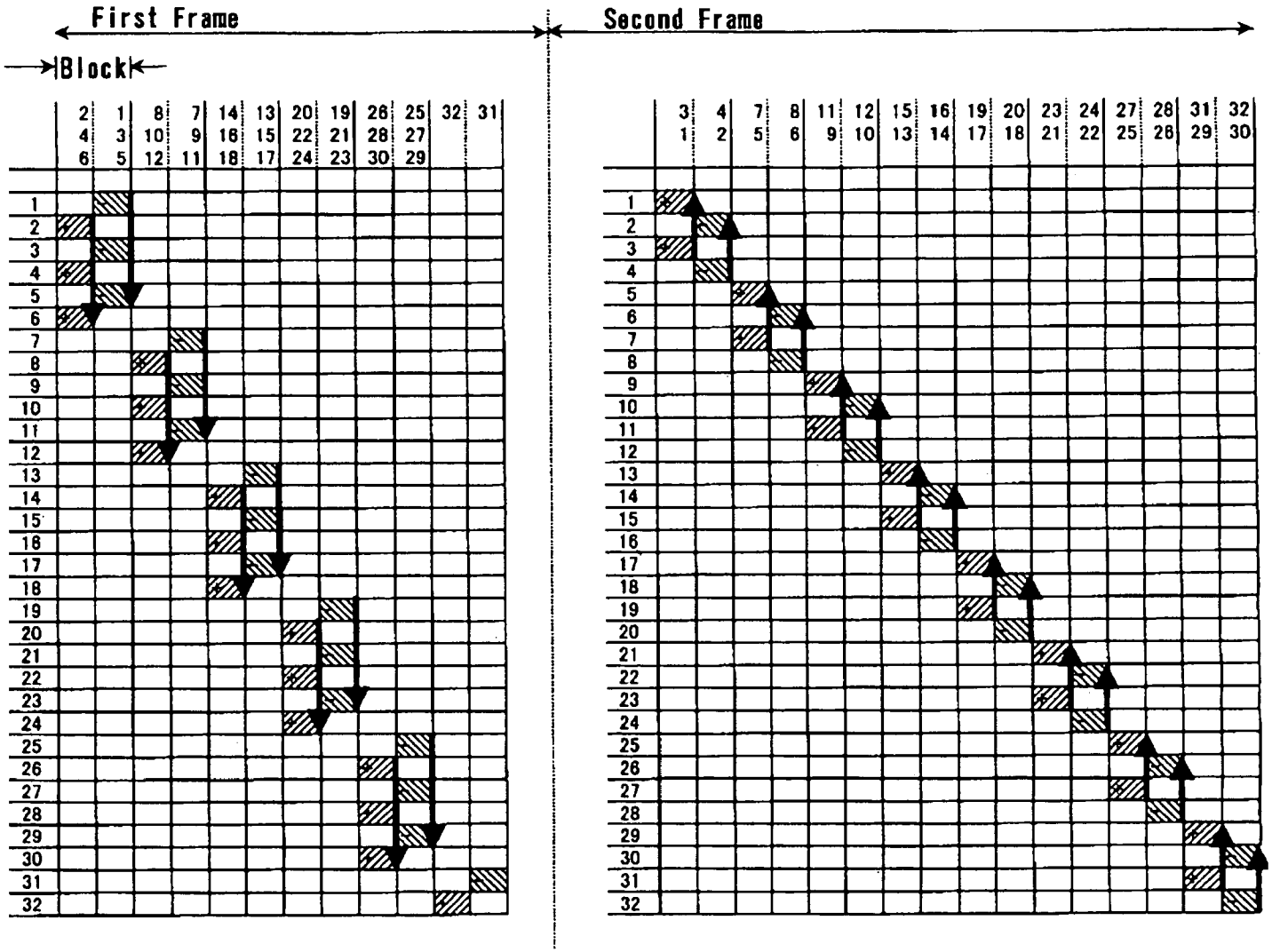

[Fig. 33]
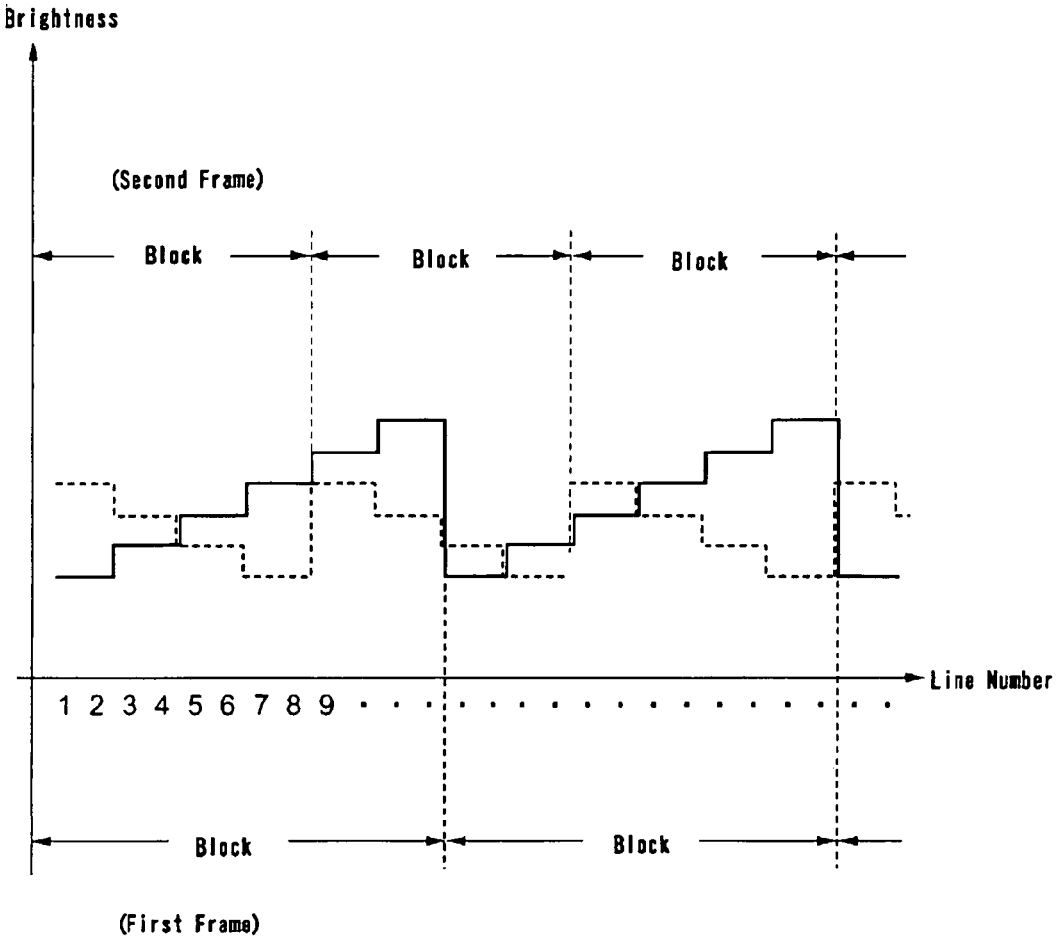

[Fig. 34]
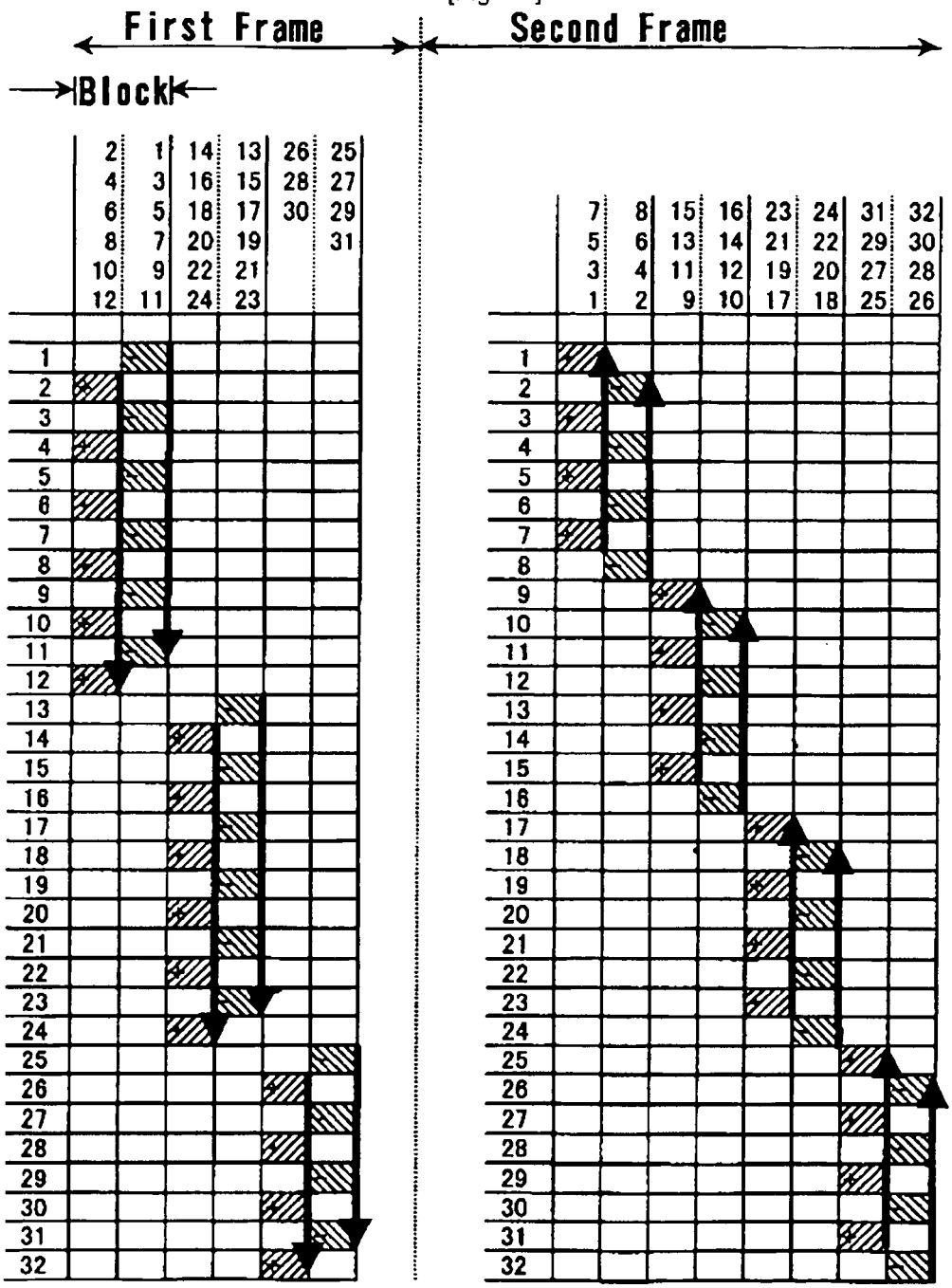

[Fig. 35]
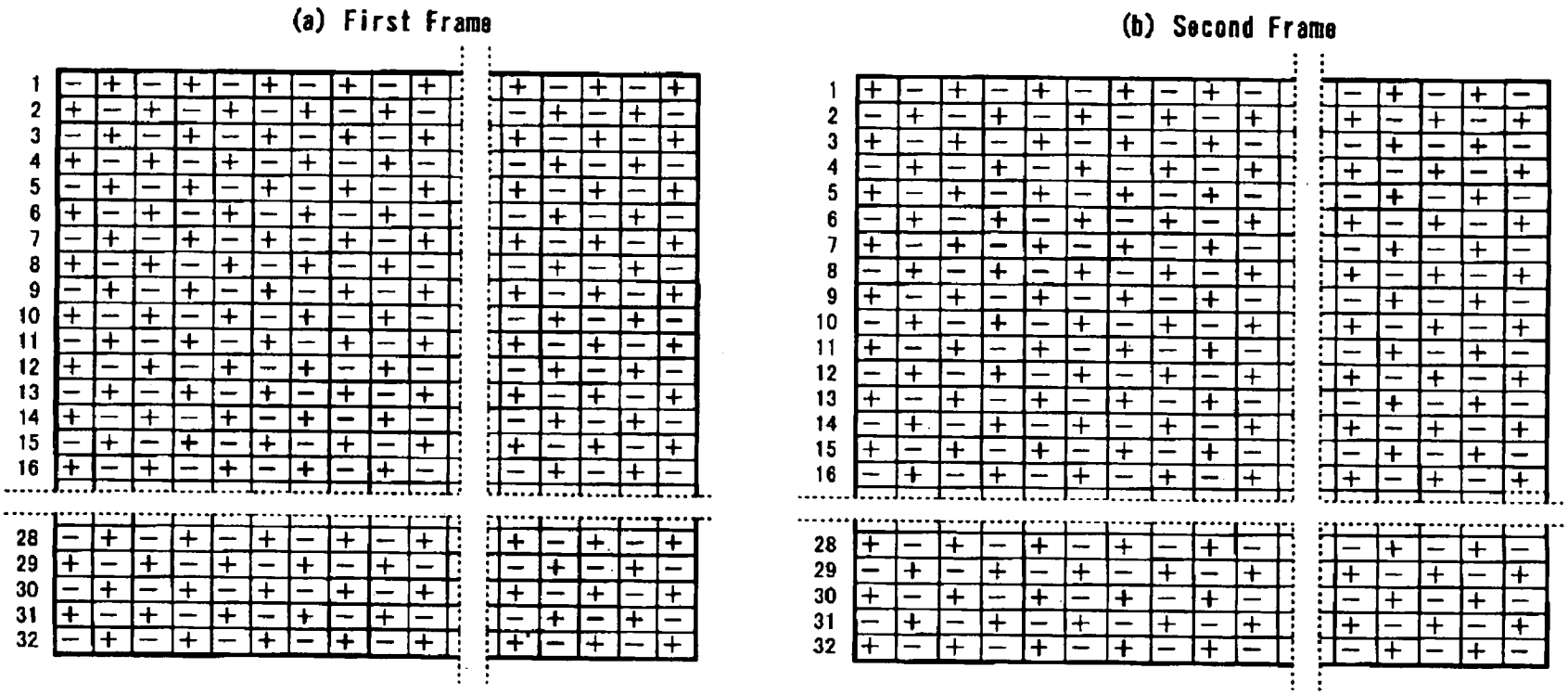

[Fig. 36]
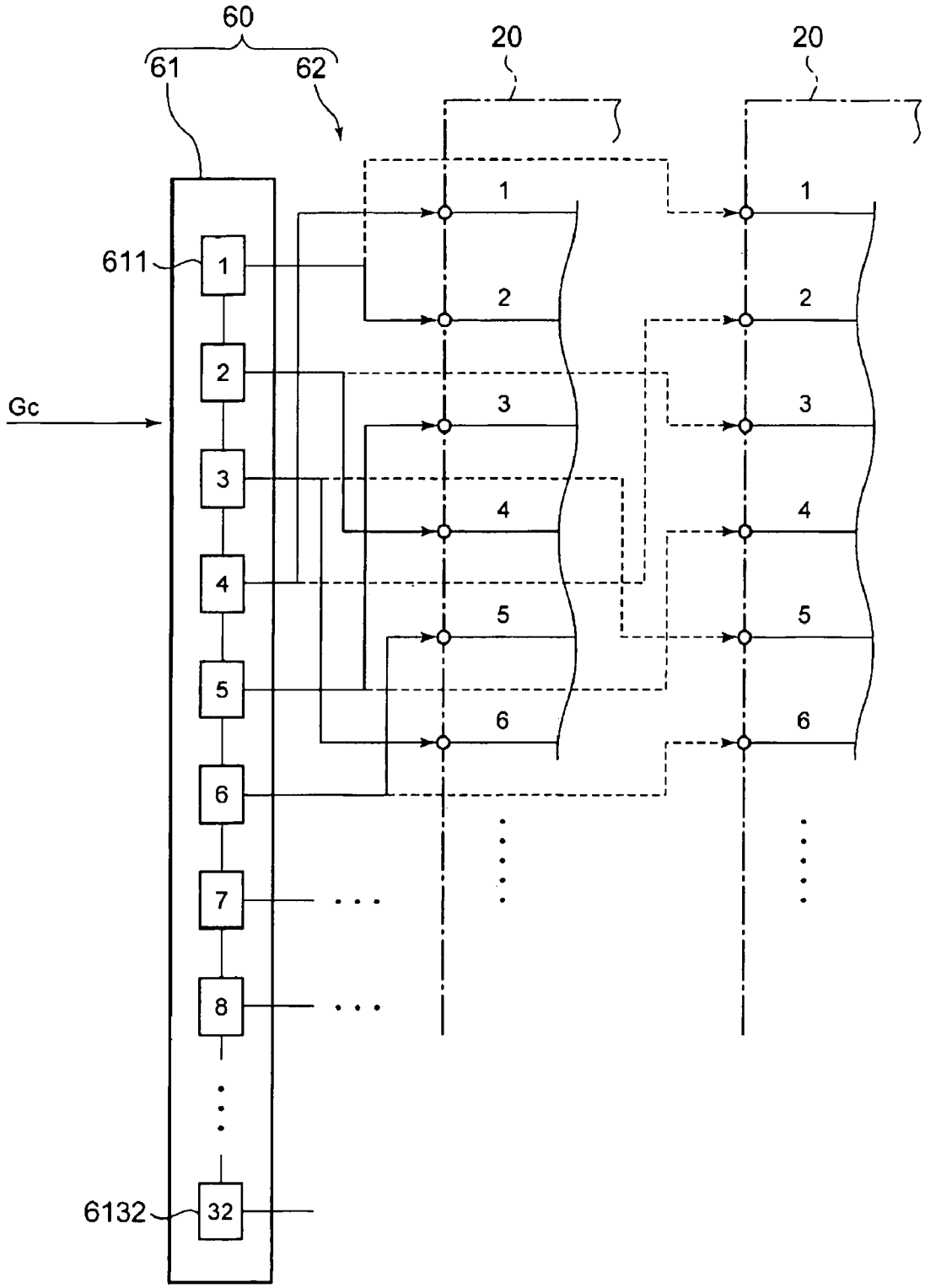

MATRIX ADDRESSING CIRCUITRY AND LIQUID CRYSTAL DISPLAY DEVICE USING THE SAME

TECHNICAL FIELD

The present invention relates broadly to a matrix addressing method, matrix addressing circuitry and a liquid crystal display device using the same. The invention relates more particularly to a matrix addressing method and circuitry and a display device using the same conforming to the alternate driving method used in liquid crystal display devices and the like.

BACKGROUND ART

The so-called alternate driving method has conventionally been applied to a number of active matrix type liquid crystal display devices. This method is measures against degradation phenomena such that material properties of liquid crystal are changed when the liquid crystal is driven with DC voltage for a long time and its resistance decreases, and is intended to invert the polarity of the driving voltage to apply to the liquid crystal on a frame basis. The more specific basic operation is disclosed in Non-Patent Document 1 and so on.

Basically, flicker occurs when the polarity inversion frequency of the driving voltage is one-half the frame frequency. In the alternate driving method, by averaging the polarity inversion in a screen spatially and temporally, the fundamental component of the optical response ripple is made at the frame frequency or more, thereby preventing an occurrence of flicker (visible flicker). More specifically, any one pixel and its adjacent pixels (or adjacent row of pixels or column of pixels) are made different in driving voltage polarity, and further, their polarities are inverted on a frame basis.

In this conventional technique, a polarity inversion rate of the driving voltage is high, and for this reason, the driving circuitry has a tendency to require large power consumption. In contrast thereto, Patent Document 1 filed by the same applicant as in the present invention is intended to make power savings while keeping a form of alternate driving. The addressing method according to this is a matrix addressing method for alternately driving pixels arranged in matrix, wherein: a plurality of row electrodes extending in a horizontal direction of a display screen are made to be selectively active for each horizontal scanning period of images to be displayed; a plurality of column electrodes extending in a vertical direction of the display screen are applied with respective pixel voltages that are responsive to the image and correspond to the horizontal scanning period while the pixel voltages have polarities alternating for each frame period of the images; and the pixel voltages have polarities alternating in the vertical direction spatially in a display area within the frame period, the method including: successively sequencing on a time series an application timing of the pixel voltages for one row electrode and an application timing of the pixel voltages for the other row electrode, the pixel voltages for the other row electrode being to be in the same polarities as the pixel voltages for the one row electrode; and activating the corresponding row electrode in response to each of the application timings of the pixel voltages for the one and the other row electrodes.

In Patent Document 1, such a method offers achievement of reduction in power consumption in that a polarity inversion rate of pixel voltages on the time axis is made lower while keeping a spatial inversion form of polarities of pixel voltages on a screen at the conventional alternating pattern.

[Non-Patent Document 1] Publication 'Liquid Crystal Display Technology-Active Matrix LCD-' MATSUMOTO, Shoichi, Nov. 14, 1997, 2nd Impression, Sangyo Tosho Kabushiki Kaisya, pages 69 to 74

[Patent Document 1 ] Japanese Patent Application Laid-Open No. 2003-114647 (particularly see Claims, FIGS. 2 and 3, and Paragraphs [0031] to [0059])

DISCLOSURE OF INVENTION

Technical Problem

In the above-mentioned conventional technique, however, when making some gray or black display uniformly over the entire screen for example, it turned out that a problem on displaying occurs that relatively bright and dark horizontal stripes alternately appear repeatedly on the entire screen, another problem on displaying occurs and that the brightness gradually decreases or increases in the vertical direction on the screen for each set of row electrodes driven by one polarity and the adjacent row electrodes driven by the other polarity. Particularly, the latter problem becomes a serious issue in increasing the number of row electrodes to be driven with the same polarity. It should be noted that the aforementioned problems on displaying will be referred to as artefacts, and the former one is referred to as an inter-line artefact, while the latter one will be referred to as an intra-block (block-period-base) artefact. Claims are also defined in the same way.

A principal object of the invention is to provide matrix addressing circuitry and liquid crystal display device conforming to the alternate driving method, which can reduce power consumption while preventing an occurrence of the above-mentioned artefacts.

Another object of the invention is to provide a matrix addressing method and circuitry, and liquid crystal display device using the same, which can contribute to diversification of the alternate driving method capable of reducing power consumption by making good use of electronic circuit techniques such as memory.

Technical Solution

In order to achieve the above-mentioned objects, a first aspect of the invention is a matrix addressing method for alternately driving pixels arranged in matrix, wherein: a plurality of row electrodes extending in a horizontal direction of a display screen are made to be selectively active for each horizontal scanning period of images to be displayed; a plurality of column electrodes extending in a vertical direction of the display screen are supplied with respective pixel voltages that are responsive to the image and correspond to the horizontal scanning period while the pixel voltages have polarities alternating for each frame period of the images; the pixel voltages have polarities alternating in the vertical direction spatially in a display area within the frame period; the frame period of the images is formed by successively sequencing on a time series a plurality of block periods, the block periods each being composed of a first half block and a second half block, the first half block being a period for successively sequencing on a time series application timings of the pixel voltages for one or more row electrodes to be provided with one polarity, the second half block being a period for successively sequencing on a time series application timings of the pixel voltages for one or more row electrodes to be provided with the other polarity; and the corresponding row electrode is made to be active in synchronization with each of the application timings of the pixel voltages for the row electrodes, wherein ones of even-numbered row electrodes and odd-numbered row electrodes in arrangement order on the display screen are selected in the first half block; the others spatially adjoining the ones are selected in the second half block; a row electrode selecting order in the first half block and a row electrode selecting order in the second half block during one frame period are made differed from orders in the corresponding half blocks during the other frame period, respectively, so as to mitigate block-period-base visual artefact.

In this way, brightness variation patterns with respect to an intended value, which are represented by pixels of row electrodes selected in the first and second half blocks, are varied whenever a frame is changed, and it is thereby possible to make the artefact on a block basis difficult to visually identify. Further, it is possible to concurrently achieve maintenance of the alternating pattern for spatial polarity inversion of pixel voltages on the screen and reduction in power consumption due to decreases in polarity inversion rate of the pixel voltages on the time axis.

In this aspect, a row electrode selecting order may be inversed between the first and second half blocks in one frame period and the corresponding half blocks in the other frame period. By doing so, the tendency of increase or decrease in the brightness variation pattern with respect to the intended value, represented by the pixels of the row electrodes selected in the first and second half blocks is changed to the reverse tendency whenever the frame is changed, and line positions of the maximum value and minimum value in the brightness variation pattern are varied whenever the frame is changed. It is thus possible to make the artefact on a block basis more difficult to visually identify.

Further, in at least two frame periods, there may be a block period in which each of row electrode selecting orders in the first and second half blocks is ascending order and a block period which corresponds to said block period and in which each of row electrode selecting orders in the first and second half blocks is descending order. Furthermore, it may be possible that use is made of only block periods in which each of row electrode selecting orders in the first and second half blocks is set to ascending order in one frame period, and use is made of only block periods in which each of row electrode selecting orders in the first and second half blocks is set to descending order in the other frame period. It is thereby possible to reduce the visibility of the artefact with more reliably.

In order to achieve the above-mentioned objects, a second aspect of the invention is a matrix addressing method for alternately driving pixels arranged in matrix, wherein: a plurality of row electrodes extending in a horizontal direction of a display screen are made to be selectively active for each horizontal scanning period of images to be displayed; a plurality of column electrodes extending in a vertical direction of the display screen are supplied with respective pixel voltages that are responsive to the image and correspond to the horizontal scanning period while the pixel voltages have polarities alternating for each frame period of the images; the pixel voltages have polarities alternating in the vertical direction spatially in a display area within the frame period; the frame period of the images is formed by successively sequencing on a time series a plurality of block periods, the block periods each being composed of a first half block and a second half block, the first half block being a period for successively sequencing on a time series application timings of the pixel voltages for one or more row electrodes to be provided with one polarity, the second half block being a period for successively sequencing on a time series application timings of the pixel voltages for one or more row electrodes to be provided with the other polarity; and the corresponding row electrode is made to be active in synchronization with each of the application timings of the pixel voltages for the row electrodes, wherein ones of even-numbered row electrodes and odd-numbered row electrodes in arrangement order on the display screen are selected in the first half block; the others spatially adjoining the ones are selected in the second half block; row electrode selecting orders in the first and second half blocks are changed between ascending order and descending order for each block period in a frame period, so as to mitigate block-period-base visual artefact.

In this way, taking example for the case where a brightness variation pattern with respect to the intended value, represented by the pixels of row electrodes selected in a block, has a tendency of increase from the minimum brightness to the maximum brightness, the brightness variation pattern in the subsequent block is set in a tendency of decrease from the maximum brightness to the minimum brightness. It is thus possible to moderate a change in brightness on the boundary between blocks in a frame, and to make the artefact for each block less visible.

In this aspect, a frame period may have mixture of block periods in which each of row electrode selecting orders in the first and second half blocks is ascending order and block periods in which each of row electrode selecting orders in the first and second half blocks is descending order. It is thereby possible to exhibit the artefact reduction effect with more reliability.

Further, use is made of ascending-ordered block periods in which each of row electrode selecting orders in the first and second half blocks is ascending order and descending-ordered block periods in which each of row electrode selecting orders in the first and second half blocks is descending order with the ascending-ordered block periods and the descending-ordered block periods being alternated with each other during one frame period, and each of row electrode selecting orders in the first and second half blocks in a block period corresponding to the ascending-ordered block period is descending order and each of row electrode selecting orders in the first and second half blocks in a block period corresponding to the descending-ordered block period is ascending order during the other frame period. By this means, the peak and trough of the brightness variation pattern are reversed whenever a frame is changed, and it is thus possible to further make the artefact unobtrusive.

Each of aforementioned aspects may be set in a mode wherein successive first to fourth frame periods, a row selecting pattern defined in the first frame period is used for one of the third and fourth frame periods and a row selecting pattern defined in the second frame period is used for the other of the third and fourth frame periods, in which the image is formed by repetition of the first to fourth frame periods or by a frame period sequence including the first to fourth frame periods, so that a frequency with which a drive polarity is the one polarity is substantially equal to a frequency with which a drive polarity is the other polarity for each row electrode. In this way, the balance is achieved between one and the other polarities shown in each row electrode, and it is thus possible to prevent each electrode from leaning to either polarity of potential due to successive image display operation.

Further, by making the number of row electrodes selected in each block period different between one frame period and the other frame period, it is possible to change a variation period of the brightness variation pattern whenever the frame is changed, and the artefacts are thus averaged and hard to visually identify.

Furthermore, a specific frame period including an exceptional block period having the number of selected row electrodes different from that in other block periods may be used every two frame periods or every predetermined number of frame periods. By this means, in the specific frame period, the brightness variation pattern is shifted with respect to the other frame period due to existence of the exceptional block period, and it is possible to average the artefacts and to reduce the visibility of the artefacts. In this mode, by using the exceptional block period as a beginning block period in a frame period, it is possible to obtain the intended effects with reliability.

In each of the above-mentioned aspects and modes, row electrodes selected in a preceding half block in the block period in one frame period may be made row electrodes selected in a following half block in the block period in the next frame period. It is thereby possible to also reduce the artefacts of horizontal stripes as described above.

The invention also provides a matrix addressing circuit for alternately driving pixels arranged in matrix, wherein: a plurality of row electrodes extending in a horizontal direction of a display screen are made to be selectively active for each horizontal scanning period of images to be displayed; a plurality of column electrodes extending in a vertical direction of the display screen are supplied with respective pixel voltages that are responsive to the image and correspond to the horizontal scanning period while the pixel voltages have polarities alternating for each frame period of the images; and the pixel voltages have polarities alternating in the vertical direction spatially in a display area within the frame period, the matrix addressing circuit comprising: control means for forming the frame period of the images by successively sequencing on a time series a plurality of block periods, the block periods each being composed of a first half block and a second half block, the first half block being a period for successively sequencing on a time series application timings of the pixel voltages for one or more row electrodes to be provided with one polarity, the second half block being a period for successively sequencing on a time series application timings of the pixel voltages for one or more row electrodes to be provided with the other polarity; and row driving means for making the corresponding row electrode to be active in synchronization with each of the application timings of the pixel voltages for the row electrodes, wherein ones of even-numbered row electrodes and odd-numbered row electrodes in arrangement order on the display screen are selected in the first half block; the others spatially adjoining the ones are selected in the second half block; a row electrode selecting order in the first half block and a row electrode selecting order in the second half block during one frame period are made differed from orders in the corresponding half blocks during the other frame period, respectively, so as to mitigate block-period-base visual artefact.

The invention further provides a matrix addressing circuit for alternately driving pixels arranged in matrix, wherein: a plurality of row electrodes extending in a horizontal direction of a display screen are made to be selectively active for each horizontal scanning period of images to be displayed; a plurality of column electrodes extending in a vertical direction of the display screen are supplied with respective pixel voltages that are responsive to the image and correspond to the horizontal scanning period while the pixel voltages have polarities alternating for each frame period of the images; the pixel voltages have polarities alternating in the vertical direction spatially in a display area within the frame period, the matrix addressing circuit comprising: control means for forming the frame period of the images by successively sequencing on a time series a plurality of block periods, the block periods each being composed of a first half block and a second half block, the first half block being a period for successively sequencing on a time series application timings of the pixel voltages for one or more row electrodes to be provided with one polarity, the second half block being a period for successively sequencing on a time series application timings of the pixel voltages for one or more row electrodes to be provided with the other polarity; and row driving means for making the corresponding row electrode to be active in synchronization with each of the application timings of the pixel voltages for the row electrodes, wherein ones of even-numbered and row electrodes and odd-numbered row electrodes in arrangement order on the display screen are selected in the first half block; the others spatially adjoining the ones are selected in the second half block; row electrode selecting orders in the first and second half blocks are changed between ascending order and descending order for each block period in a frame period, so as to mitigate block-period-base visual artefact.

In the above each addressing circuit, the row driving means may comprise a shift-register which is composed of a plurality of unit registers cascaded from a front end unit register to a tail end unit register and in which a significant output of a unit register to the side of the front end unit register is sequentially shifted to a unit register to the side of the tail end unit register for each horizontal scanning period and at the same time the significant output causes the row electrode to be active; and the outputs of the unit registers are connected to the row electrodes, respectively in such a manner that the sequential shifting operation leads to the realization of the row electrode selecting order. In this way, just simply doing the sequentially shifting operation of the shift-register conventionally from its one end side to the other end side can preferably make the row electrodes to be active in the desired order. Such a configuration can offer advantages of preventing complication of an inner structure of the row driving means, and more.

DESCRIPTION OF DRAWINGS

FIG. 1 is a block diagram showing a schematic structure of a matrix addressing circuit according to an embodiment of the present invention.

FIG. 2 is a time chart for explaining an operation of a matrix addressing circuit according to a basic technique of the embodiment of the invention.

FIG. 3 is a schematic illustration showing line-by-line alternately-driving manner.

FIG. 4 is a circuit diagram showing adjacent pixel electrodes and its peripheral configuration.

FIG. 5 is an equivalent circuit diagram of a pixel electrode and capacitances coupled thereto.

FIG. 6 is a table for explaining a driving manner according to the basic technique.

FIG. 7 is an illustration showing a first process on the occasion of line updating in a driving manner according to the basic technique.

FIG. 8 is an illustration showing a next process on the occasion of line updating in a driving manner according to the basic technique.

FIG. 9 is an illustration showing a last process on the occasion of line updating in a driving manner according to the basic technique.

FIG. 10 is a graph for explaining line-by-line artefact caused by the basic technique.

FIG. 11 is a graph for explaining block-by-block artefact caused by the basic technique.

FIG. 12 is a time chart for explaining an operation of a matrix addressing circuit according to a first embodiment of the invention.

FIG. 13 is a graph showing a characteristic of line number vs. brightness, presented in a second frame in the first embodiment of the invention.

FIG. 14 is a table representing a driving manner according to the first embodiment of the invention.

FIG. 15 is a table for explaining a driving manner according to the second embodiment of the invention.

FIG. 16 is a table for explaining a driving manner according to a modification of the second embodiment of the invention.

FIG. 17 is a table showing a driving manner in first and second frames according to the third embodiment of the invention.

FIG. 18 is a table showing a driving manner in third and fourth frames according to the third embodiment of the invention.

FIG. 19 is a table showing a driving manner in first and second frames according to a modification of the third embodiment of the invention.

FIG. 20 is a table showing a driving manner in third and fourth frames according to a modification of the third embodiment of the invention.

FIG. 21 is a graph showing a characteristic of line number vs. brightness according to a fourth embodiment of the invention.

FIG. 22 is a table representing a driving manner according to a fourth embodiment of the invention.

FIG. 23 is a graph showing a characteristic of line number vs. brightness according to a fifth embodiment of the invention.

FIG. 24 is a table representing a driving manner according to a fifth embodiment of the invention.

FIG. 25 is a graph showing a characteristic of line number vs. brightness according to a sixth embodiment of the invention.

FIG. 26 is a table representing a driving manner according to a sixth embodiment of the invention.

FIG. 27 is a graph showing a characteristic of line number vs. brightness according to a seventh embodiment of the invention.

FIG. 28 is a table representing driving manner according to a seventh embodiment of the invention.

FIG. 29 is a graph showing a characteristic of line number vs. brightness according to an eighth embodiment of the invention.

FIG. 30 is a table representing a driving manner according to an eighth embodiment of the invention.

FIG. 31 is a graph showing a characteristic of line number vs. brightness according to an eighth embodiment of the invention.

FIG. 32 is a table representing a driving manner according to an eighth embodiment of the invention.

FIG. 33 is a graph showing a characteristic of line number vs. brightness in the other form according to a ninth embodiment of the invention.

FIG. 34 is a table representing a driving manner in the other form according to a ninth embodiment of the invention.

FIG. 35 is a schematic illustration showing dot-by-dot alternately-driving manner.

FIG. 36 is an illustration showing a configuration of a gate driver and connection relations between the driver and gate lines of a display panel, according to a modification in the invention.

BEST MODE

The above-mentioned aspects and implementations of the invention will be described in more detail below by way of embodiment with reference to accompanying drawings.

FIG. 1 illustrates a schematic structure of a matrix addressing circuit in a liquid crystal display device according to one embodiment of the invention.

In this figure, a matrix addressing circuit 10 is configured to drive a display panel 20 of an active matrix type liquid crystal display (LCD) device in which, for example, field-effect thin-film transistors (TFTs) 21 as pixel-driving active elements are arranged in a predetermined display area in correspondence with individual pixels.

In the display panel 20, the TFTs 21 are arranged in the form of a Y rows and X columns matrix. The gate electrode of the TFT 21 is connected to a gate bus line (hereinafter, simply referred to as a gate line) extending in parallel laterally, i.e. in a horizontal direction over the display area for each row. The source electrode of the TFT 21 is connected to a source bus line (hereinafter, simply referred to as a source line) extending in parallel longitudinally, i.e. in a vertical direction over the display area for each column. The drain electrodes of TFTs 21 are connected to pixel electrodes 23 individually.

The display panel 20 is further provided with a common electrode 25 which is opposed to the pixel electrodes 23 and disposed with a clearance. The clearance is filled with a liquid crystal medium not shown. Herein, the common electrode 25 extends across the entire display area. The TFT 21 is switched on selectively for each row by a gate signal as a row electrode signal supplied through the gate line, and set to a driven state according to pixel information to be displayed, by a level of a source signal as a column electrode signal supplied through the source line to each TFT having been switched on. The pixel electrode 23 is given an electric potential corresponding to the driven state by the drain electrode. By an electric field of a strength determined by a difference between the pixel electrode potential and a voltage level given to the common electrode 25, the orientation of the liquid crystal medium is controlled for each pixel electrode. Thus, the liquid crystal medium can to modulate the backlight from a backlight system not shown and the external light from the front side for each pixel in accordance with the pixel information. Details of the basic structure of the liquid crystal display panel are well known in various documents, and so further descriptions thereof are omitted herein.

The addressing circuit 10 comprises a basic configuration having a timing control and voltage producing circuit 30 as a previous stage circuit thereof, a memory 40 for image data storage, a source driver 50 as column driving means, and a gate driver 60 as row driving means.

The timing control and voltage producing circuit 30 receives an image data signal 'data' for each of red (R), green (G) and blue (B), a dot clock signal CLK, and a synchronization signal Sync including horizontal and vertical sync signals from signal supplying means not shown, transfers the image data signal to the memory 40, and based on the clock signal CLK and synchronization signal Sync, generates a memory control signal Mc to control the memory 40, a latch signal St to sync-operate the source driver 50, and a control signal Gc to control the gate driver 60. The circuit 30 further generates a voltage signal Vcom to be supplied to the common electrode 25 in the display panel 20. Besides, the circuit 30 generates and supplies a reference voltage and more used in the source driver 50 and gate driver 60, but descriptions thereof are omitted in this embodiment for the sake of simplicity.

The memory 40 receives image data signals of R, G and B from the circuit 30 and sequentially stores the signals for each color for each horizontal scanning period, while performing data processing (time-series operation processing) specific to the invention, described later, on the stored signals based on the memory control signal from the circuit 30. The image data signal 'data' having subjected to the data processing is transferred to the source driver 50.

The source driver 50 has a digital-analogue converter for each of image data signals of R, G and B, wherein the image data signal of each color is converted to an analogue signal for each horizontal scanning period, and pixel signals carrying pieces of pixel information to be displayed in one horizontal scanning period (i.e. pixel information for one line) are generated. The pixel signals are held as source signals until a next horizontal scanning period comes, and supplied to the corresponding source lines. It is noted that the latch signal St supplied to the source driver 50 serves as a reference of necessary timings including the horizontal scanning period and more in the display operation such as analogue conversion, voltage supply to the source line.

The gate driver 60 selectively supplies, for example, a predetermined high voltage to the bus line to selectively activate the gate line in the display panel 20 in a mode responsive to the control signal Gc from the circuit 30. The activated gate bus line renders the corresponding TFTs at on-state, and enables concurrent driving of the TFTs for one line by the source signal supplied to the TFTs. By this means, pixels of a row corresponding to the activated gate line are concurrently optically modulated in accordance with the pixel information of that one line. Details will be described later on the control of the gate driver 60 by the control signal Gc from the circuit 30.

While the operation of the addressing circuit 10 will be described below, described first is an example of the operation according to fundamental technique for this embodiment, prior to descriptions of the operation specific to this embodiment.

FIG. 2 schematically illustrates the operation of the addressing circuit 10 according to the fundamental technique. As shown in FIG. 2, the image data signal 'data' is transferred to the memory 40 in the order of the first-line pixel data, second-line pixel data, third-line pixel data, . . . from the beginning of a frame period, when the line number is incremented from an upper row to a lower row in the display area on the display panel 20. Such a line-sequential image data sequence signal is stored in the memory 40 for each line in the order in which the signal is transferred (i.e. in the line sequence without change).

The memory 40 reads out the thus stored image data signals, while performing the time-series operation processing on the signals, based on the control signal Mc from the circuit 30. The fundamental technique as well as various embodiments of the invention described later are aimed at the so-called inter-row alternate driving as shown in FIG. 3. In this driving, as shown in FIG. 3(*a*), distribution of one line basis alternating polarities is represented within a screen in a frame period of an image such that pixels in the first line (row) are driven with a negative polarity, pixels in the second line are driven with a positive polarity, pixels in the third line are driven with a negative polarity, and so forth, for example. Further, in the next frame period, as shown in FIG. 3(*b*), the alternate polarity distribution is maintained such that the pixels in the first line are driven with a positive polarity, the pixels in the second line are driven with a negative polarity, the pixels in the third line are driven with a positive polarity, and so forth, but each row is driven with a polarity different from that in the previous frame. The inter-row alternate driving is achieved by repeating the driving patterns (a) and (b) alternately. The spatial polarity inversion distribution in a screen as shown in FIG. (3) is known per se in the above Non-Patent Document 1 etc. In order to implement such spatial polarity inversion of the pixels in a screen, the respective rows are selected sequentially from top to bottom in the screen, and for example, the source driver is supplied with the image data of the polarity corresponding to the selected row.

In the embodiments and fundamental technique according to the invention, instead of selecting each row sequentially from top to bottom in the screen, rows of pixels to be in the same polarity are successively selected on the time series, and the source driver 50 converts the corresponding pixel data into analogue source signals in compliance with the selected row and a polarity given to the row. The voltage generating circuit 30 generates the voltage Vcom applied to the common electrode 25 with a polarity suitable for the given polarity. As can be seen from FIG. 3, pixels in odd-numbered lines are to be driven with the same polarity even if the frame period is changed. Similarly, pixels in even-numbered lines are to be driven with the same polarity even if the frame period is changed. Basically in the fundamental technique, as shown in FIG. 2, pixel data of three odd-numbered lines on the 'data' sequence are replaced on the time axis to be pixel data of consecutive lines, while pixel data of three even-numbered lines are replaced on the time axis to be pixel data of consecutive lines (see broken arrows and solid arrows). Therefore, as in the 'data' sequence, the pixel data of three even-numbered lines each driven with one polarity (for example, +) is sequenced on the time series for three lines, and then, the pixel data of three odd-numbered lines each driven with the other polarity (for example, −) is sequenced on the time series for three lines. It is noted that FIG. 2 does not show real time interrelationship between the data sequences 'data' and 'data', and for the sake of simplicity, shows a situation of the replacement mainly to be visually recognized.

By performing such replacement or rearrangement of pixel data on the time series, as a result, the image data sequence 'data' are obtained with the line order of the second (+), fourth (+), sixth n (+), first (−), third (−), fifth n (−), . . . from the beginning of the frame period. To perform this operation, the memory 40 is subjected to readout control so that the image data of the lines are rearranged on the time series as described above. Based on the latch signal St, i.e. in this example, a timing signal having a level becoming significant in cycles of the horizontal scanning period, the source driver 50 updates and outputs the pixel data for one line from the memory 40 in response to a change to the significant level.

The source signal Ssig shown in FIG. 2 is based on the rearranged pixel data, and observed at any one of source lines. Herein, as an example, a level of the source signal Ssig indicates a level Vd or −Vd in displaying the same gray on the entire screen (i.e. the maximum value of Vd or −Vd if black display is performed on a normally white type liquid crystal display panel). Since the source signal Ssig is based on a set of pixel data of three lines with the same polarity, it is reversed every three horizontal scanning periods (3H). The voltage Vcom to supply to the common electrode 25 is an alternating voltage also being reversed every three horizontal scanning periods corresponding to a driving polarity in the circuit 30. The source signal Ssig is generated in the source driver 50 to have a gray level commensurate with the alternating voltage.

The gate driver 60 performs scanning operation to activate a gate line corresponding to the line selected as in the above description. In other words, based on the control signal Gc from the timing control circuit 30, the gate driver 60 generates a gate control signal to activate gate lines in line order of the second (+), fourth (+), sixth (+), first (−), third (−), fifth (−), . . . from the beginning of the frame period. FIG. 2 shows this situation in schematic form depicting contents of the control signal Gc, which means that a gate control signal is generated to activate a gate line corresponding to each number shown here.

In the next, second frame, in order to achieve a spatial polarity distribution of FIG. 3(*b*), with the polarity changed, gate lines are activated in line order of the second (−), fourth (−), sixth (−), first (+), third (+), fifth (+), . . . from the beginning of the frame period, and the respective corresponding source signals are generated and output.

According to the aforementioned operation, since the time-series operation processing is performed to make a time-axis succession of processes for pixel information supply and scanning for lines to be in the same polarity, it is possible to increase an inversion period of the source signal Ssig and voltage Vcom to be applied to the common electrode, and therefore, to lower the frequency. It is thereby possible to reduce driving energy or power consumption, while keeping the polarity inversion distributions for driving pixels within the screen as shown in FIG. 3.

However, the inventors of the invention found out that problems may occur in quality of a displayed image in the aforementioned fundamental technique, and implemented embodiments described below by adding improvements to the fundamental so as to overcome the problems. The first problem is artefact (inter-line artefact) such that in a remarkable example where uniform gray is displayed on the entire screen, a brightness difference arises between pixels of odd-numbered rows and pixels of even-numbered rows, and relatively bright and dark horizontal stripes alternately appear repeatedly on the entire screen. The second problem is artefact (intra-block artefact) such that in the same example as described above, the brightness gradually decreases or increases in the vertical direction (perpendicularly to lines) in a block on the screen for each block (block of 6H shown in FIG. 2) consisting of a set of a plurality of odd-numbered lines (for example, the first, third and fifth lines) successively driven and an adjacent set of a plurality of even-numbered lines (for example, the second, fourth and sixth lines) successively driven.

Either artefact is generally caused generally by fluctuations in intended potential to be applied to the pixel electrode due to some effects, and this is considered to significantly rely on potential fluctuations via especially capacitances and parasitic capacitances formed on the periphery of the pixel electrode. Then, the inventors performed following analysis.

FIG. 4 shows a schematic structure of upper and lower two adjacent pixel electrodes P1 and P2 which are arbitrarily selected in the display area and their peripheral elements, and capacitances and equivalent capacitances formed therewith.

In the display area, a plurality of gate lines extending in the horizontal direction of the display area and a plurality of source lines extending in the vertical direction of the display area are arranged to intersect each other on the plan view. The pixel electrode is provided for each pixel, and the TFT 21 is provided for each pixel electrode to apply the potential corresponding to the pixel information to be displayed, individually to the pixel electrode. The gate line is connected to the gate electrode of the TFT 21, and the source line is connected to the source electrode of the TFT 21. The drain electrode of the TFT 21 is connected to the pixel electrode. The pixel electrodes P1 and P2 shown in the figure are formed in two regions defined by gate lines $G_y$, $G_{y+1}$ and $G_{y+2}$ and source lines $S_x$ and $S_{x+1}$, or in association with the two regions. Further, in the display area, a storage capacitance Ccs used for display with a principal capacitance (CLC) formed by each pixel electrode is formed for each pixel, and the storage capacitances are connected in common by a bus line (hereinafter, referred to as a Cs line) extending in the horizontal direction of the display area.

In the aforementioned structure, the following capacitances are considered to be primarily formed on the periphery of the pixel electrode.

CLC: capacitance formed between the pixel electrode and the common electrode (the electrode 25 shown in FIG. 1)

Cgbnext: capacitance formed between the pixel electrode and a gate line disposed before another gate line to drive the pixel electrode Ccs: the above-mentioned storage capacitance (capacitance formed between the pixel electrode and the Cs line)

Cs-pixelL: capacitance formed between the pixel electrode and a source line (source line on the left side of the pixel electrode in FIG. 4) connected to the source electrode of the TFT connected to the pixel electrode Cs-pixelR: capacitance formed between the pixel electrode and an adjacent source line (source line on the right side of the pixel electrode in FIG. 4) other than the aforementioned source line CsdTFT: capacitance formed between the source electrode and the drain electrode of the TFT Cg-pixel: capacitance formed between the pixel electrode and a gate line (gate line on the lower side of the pixel electrode in FIG. 4) connected to the gate electrode of the TFT connected to the pixel electrode CgdTFT: capacitance formed between the gate electrode and the drain electrode of the TFT Cdd: capacitance formed between the pixel electrode and another (upper or lower) electrode driven by a gate line disposed before or after the gate line to drive the pixel electrode It is noted in FIG. 4 that subscripts to distinguish between capacitances relating the pixel electrode P1 and capacitances relating to the pixel electrode P2 are added to symbols representing the aforementioned capacitances, but when such distinguishing is not required, description will be made with the subscripts being omitted as appropriate.

According to the example as described above, as can be seen from FIG. 2, the source signal Ssig and common electrode signal Vcom repeat, from the beginning of a frame, a driving period with one polarity for at least one line and a subsequent driving period with the other polarity for at least one line. Hereinafter, a pair of these two successive periods is referred to as a block. In other words, the source signal Ssig and common electrode signal Vcom have two polarities, one and the other, for each block from the beginning of the frame, and continue one polarity for three or one line in the first half of the block, while continuing the other polarity for three or one line in the latter half of the block. Further, the polarities of the source signal Ssig and common electrode signal Vcom, which are defined in the first and latter halves of a block in the first frame are reversed respectively in the second frame. The Cs lines are supplied with a signal of a level varying in the same way as in the common electrode signal Vcom. It is thereby possible to provide the storage capacity Cs with the same function as the CLC and double the capability of holding the pixel information.

[View on Potential Fluctuation in Pixel Electrodes]

FIG. 5 shows rewritten relationships among the pixel electrode and various capacitances formed therewith as shown in FIG. 4. For example, the pixel electrode P1 is coupled with one ends of capacitances CLC, Cgbnext, Ccs, . . . , Cdd described above, and these capacitances are given at the other ends the respective potentials VLC, Vgbnext, Vcs, . . . , Vdd. Assuming that the potential at the pixel electrode P1 is V1, the total charge Q1 of the pixel electrode P1 is as follows:

$$Q1=CLC(V1-VLC)+Cgbnext(V1-Vgbnext)+Ccs(V1-Vcs)+\ldots+Cdd(V1-Vdd) \quad (1)$$

When Vdd changes to Vdd', assuming that the total charge of the pixel electrode P1 at that time is Q1', and due to such change of Vdd, the potential of the pixel electrode P1 changes to V1', the following determines Q1':

$$Q1'=CLC(V1'-VLC)+Cgbnext(V1'-Vgbnext)+Ccs(V1'-Vcs)+\ldots+Cdd(V1'-Vdd') \quad (2)$$

From the charge conservation law, Q1'=Q1 and Q1'−Q1=0. Accordingly, from above two equations, the following equation is derived:

$$(CLC+Cgbnext+Ccs+\ldots+Cdd)(V1'-V1)+Cdd(Vdd-Vdd')=0 \quad (3)$$

Therefore, potential fluctuation V1'−V1 in the pixel electrode P1 when the end potential Vdd of Cdd changes to Vdd' is as follows:

$$V1'-V1=\{Cdd/(CLC+Cgbnext+Ccs+\ldots+Cdd)\}\times(Vdd'-Vdd) \quad (4)$$

Herein, assuming Ctotal=CLC+Cgbnext+Ccs+ . . . +Cdd, the voltage loss is Vloss and V1'=V1−Vloss, where V1'−V1 is a fluctuation with respect to a desired voltage V1 in the pixel electrode P1 due to a change from Vdd to Vdd', $$Vloss=-(V1'-V1)=(Cdd/Ctotal)\times(Vdd-Vdd') \quad (5)$$

Therefore, the voltage loss the pixel electrode P1 suffers based on Vdd−Vdd' corresponding to the disturbance potential fluctuation is obtained by multiplying Vdd−Vdd' by a ratio (Cdd/Ctotal) of a value of the capacitance (Cdd) having the disturbance potential fluctuation to a total value (Ctotal) of the capacitances coupled to the pixel electrode P1. Any voltage losses on the pixel electrode about other capacitances which may have disturbance potential fluctuation can be obtained in the same way.

It is noted that since upper and lower two adjacent pixel electrodes actually exist for one pixel electrode, Cdd's of both the adjacent pixel electrodes, i.e. 2Cdd should be taken into account when considering how the one pixel electrode is affected by potential fluctuation under the adjacent pixel electrodes. Accordingly, the above equation (5) is rewritten as follows:

$$Vloss=-(V1'-V1)=(2Cdd/Ctotal)\times(Vdd-Vdd') \quad (6)$$

[Consideration of Effects of Cdd]

In the example of the fundamental technique in FIG. 2, such a mode is adopted that pixels of even-numbered lines are driven and thereafter pixels of odd-numbered lines are driven in a block. Driving a pixel means applying a potential corresponding to pixel information to be displayed to a pixel electrode of the pixel. For driving of pixel(s), hereinafter, use will be made of expression such as writing information in pixel(s), pixel electrode(s), or a line, or performing writing of them, or its substantially equivalent expression. In other words, in the fundamental technique, in a block, pixel information is first written in even-numbered lines, and then, written in odd-numbered lines. Since the even-numbered line and odd-numbered line in the block are spatially adjacent to each other, pixel electrodes of lines (hereinafter, referred to as first written lines, for example, the second, fourth and sixth lines) on which writing is first performed in a block are affected by potential fluctuations at an end of Cdd caused by written in lines (hereinafter, referred to as latter written lines, for example, the first, third and fifth lines) on which writing is subsequently performed, and the affected states last until the first written lines are rewritten in the next frame, accordingly, during almost one frame. For the pixel electrodes of the first written lines, disturbance potential fluctuation is caused by a change of potential Vd to −Vd (see FIG. 2) supplied to pixel electrodes of the upper and lower adjacent latter written lines, and brings about potential fluctuation in the pixel electrodes of the first written lines via Cdd.

Therefore, according to above equation (6), the voltage loss Vloss_Cdd_F incurred in the pixel electrode of the first written line is:

$$Vloss_Cdd_F=\frac{2Cdd}{Ctotal}\times\{Vd-(-Vd)\} \quad (7)$$

Meanwhile, the latter written lines (the first, third, fifth lines, etc.) hold their intended states with which the latter written lines have been written until the first written lines (the second, fourth and sixth lines, etc.) are newly written in the next frame, i.e. for almost one frame. The latter written lines undergo effects of potential fluctuations at an end of Cdd due to writing of the first written lines when the first written lines adjacent in the block are written in the first half of the block in the next frame, but new pixel information is immediately written in the latter written lines in the latter half of the block, and therefore, such effects are negligible.

Accordingly, the voltage loss Vloss_Cdd_L incurred in the pixel electrode of the latter written line is as follows:

$$Vloss_Cdd_L=0 \quad (8)$$

[Consideration of Effects of CsbpixelL/R and CsdTFT]

As shown in FIG. 2, the potential of the source line varies from Vd to −Vd when changing the first half of the block to the latter half of the block, and varies from −Vd to Vd when changing the latter half of the block to the first half of the block. In other words, the potential of the source line is inverted every half block. Since the source line is used for writing of all the lines, pixel electrodes of some line in which information has been once written undergo effects of potential fluctuations at ends of CsbpixelL, CsbpixelR and CsdTFT caused by potential inversion in the source line, until being newly written (updated) in the next frame. The extent to which the pixel electrodes of some written line are affected is dependent on the number of times the potential with the polarity different from that of that line is applied to the source line for other lines until update of that line, i.e. the number of inverse polarity driving times. In addition, the reason why the number of inverse polarity driving times is only considered is that when the potential with the same polarity as that of the line is applied to the source line for other lines, a difference is small between the potential of the pixel electrode provided with the fluctuation and the potential difference between the common electrode and the source line, and in this case, charge transfer in the pixel electrode is considered to be extremely a little.

FIG. 6 is referred to consider this respect. FIG. 6 shows in table form a driving manner for both the first and second frames according to the same fundamental technique as in the example of FIG. 2. Row numbers from 1 to 32 at the left end indicate line numbers spatially disposed in the display area, line numbers for each half block are indicated at the upper end, a half block and a block are changed in the order of half blocks vertically shown with '2, 4, 6', '1, 3, 5', '8, 10, 12', . . . (left to right as viewed in the figure) on the time series, and the line selecting order is understood by following line numbers indicated in a half block from top to bottom. A boundary between the first half block for a one-polarity driving period and the latter half for the-other-polarity driving period is shown by a dotted line, and a boundary between blocks is shown by a solid line. Fields in the tables corresponding to selected lines are hatched with different types of hatch lines corresponding to either driving polarities, and thus, it is visually understood where the selected rows are spatially located, and with which polarity the rows are driven.

Considered first is the effect of potential fluctuations of the source line on the pixel electrode of the first written line. The first written line is an even-numbered line in this example. Referring to FIG. 6, taking as a typical example a half block '14, 16, 18' having even-numbered lines as elements, and considering on a half-block basis, for such a half block, a potential with the inverse polarity is applied to the source line when lines of half blocks having odd-numbered lines as elements such as the subsequent half block '13, 15, 17' are written, and a potential with the same polarity is applied to the source line when lines of half blocks having other even-numbered lines as elements are written. FIG. 6 illustrates these states with words of 'I' and 'S', and it is understood that inverse polarity driving is performed on six half blocks until the same half block '14, 16, 18' appears in the second frame (i.e. until the lines of this half block are updated). Among the half blocks, the last half block in a frame includes only one line, so that the number of inverse polarity driving times corresponds to sixteen lines from 5×3+1×1=16. This number is equal to half of the number of all the lines (32 in this example) used in display. The number of all lines, however, is not generally limited to an even number, a value of Int(N/2) is regarded as the number of inverse polarity driving times with the number of all lines assumed as N. The function Int( ) used herein is to derive only an integer part of the argument as an answer.

Such calculation is to obtain the number of inverse polarity driving times on a half-block basis during a period Qf from immediately after the half block of the first frame to immediately before the same half block of the second frame as shown in FIG. 6, and to obtain the accurate number of times, considered further is a driving situation at the updating time in the half block in the second frame. The respective pixel electrodes of the 14th, 16th and 18th lines of the half block in the second frame are supplied sequentially with potentials of a different polarity from that in the first frame from the source lines. In the half block of the second frame, the 14th line is first written with the inverse polarity (−), and at this time, the 16th and 18th lines are still with the same polarity. This state is shown in FIG. 7. For the 14th line, this writing means updating, i.e. writing of new pixel information, and so the desired potential is applied to the corresponding pixel electrode, thereby not leading to any potential error in that pixel electrode. However, at this point, the 16th and 18th lines are affected by one more application of the potential with the inverse polarity than in the 14th line due to the fact that the 14th line is first made to be in the inverse polarity.

Thereafter, as shown in FIG. 8, the 16th line is written with the inverse polarity (−), but at this time, the 18th line is still in the same polarity. At this point, the 16th line is indeed updated and dose not suffer any potential error. However, the 18th line is affected at the point by two more applications of the potential with the inverse polarity than in the 14th line and by one more application than in the 16th line due to the fact that the 16th line is earlier made to be in the inverse polarity.

Accordingly, as shown in FIG. 9, differences arise in the number of inverse polarity driving times among three lines until the 18th line is written in a polarity (−) reverse to that in the first frame and update of the half block is completed, i.e. during the update period of the half block. Eventually, the number of inverse polarity driving times in the above-mentioned period Qf is not changed on the 14th line, but one and two should be added to the number of inverse polarity driving times on the 16th and 18th lines, respectively. When L represents the turn of a line to be selected in the half block, the number of inverse polarity driving times is increased by L−1.

According to the aforementioned consideration, the voltage loss Vloss_Csb_F incurred in the pixel electrodes of the first written line is as follows:

$$\text{Vloss_Csb_F} = \frac{1}{N}\left\{(L-1)\times\frac{Csbpixel}{Ctotal} + \text{Int}\left(\frac{N}{2}\right)\times\frac{Csbpixel}{Ctotal}\right\}\times\{Vd-(-Vd)\} \tag{9}$$

In addition, Csbpixel=Cs-pixelL+Cs-pixelR+CsdTFT holds, and the reason why 1/N is multiplied in the equation is that the number of inverse polarity driving times are handled as a probability of being put under a condition of inverse polarity driving.

Considered next is the effect of potential fluctuations of the source line on the pixel electrode of the latter written line. The latter written line is an odd-numbered line in this example. Referring to FIG. 6 and taking as a typical example a half block '1, 3, 5' now having odd-numbered lines as elements, for this half-block, a potential with the inverse polarity is applied to the source lines when lines of half blocks having even-numbered lines as elements such as the subsequent half block '8, 10, 12' are written a potential with the same polarity is applied to the source lines when lines of half blocks having other odd-numbered lines as elements are written. In the same way as described above, it is understood that inverse polarity driving is performed on five half blocks until the same half block '1, 3, 5' is updated in the second frame. Among the half blocks, since the last half block in the frame includes only one line, the number of inverse polarity driving times corresponds to thirteen lines from 4×3+1×1=13. This number is smaller than in the case of 'first written line' by three. This is because all the pixels in the second frame are driven with their changed polarities with respect to those in the first frame, and as shown in FIG. 6, the second frame has a beginning of a driving state of the same polarity in a period Q1 from immediately after the half block in the first frame to immediately before the same half block in the second frame. Accordingly, with M assumed as the number of lines in a half block (however, excluding an exception in the final block in the frame), in the period Q1, a value of Int(N/2−M) is regarded as the number of inverse polarity driving times.

Then, in the same way as described above, considered to obtain the accurate number of times is differences in the number of inverse polarity driving times among three lines during an update period of the half block in the second frame. With respect to the differences, L is similarly used to represent the turn of a line to be selected in the half block.

According to the aforementioned consideration, the voltage loss Vloss_Csb_L incurred in the pixel electrode of the latter written line is estimated as follows:

$$\text{Vloss_Csb_L} = \frac{1}{N}\left\{(L-1)\times\frac{Csbpixel}{Ctotal} + \text{Int}\left(\frac{N}{2}-M\right)\times\frac{Csbpixel}{Ctotal}\right\}\times\{Vd-(-Vd)\} \tag{10}$$

[Consideration of Effects of Cgb-pixel, CgdTFT and Cgbnext]

The potential of the gate line basically varies between a level to turn the TFT off and another level to turn the TFT on. As is suggested from FIG. 2, the gate signal to be supplied to the gate line is activated, i.e. becomes on-level in a period of 1H, and after having the on-level transition for this short period, the gate signal continues an off-level for a long time DC-voltage-wise until the corresponding time in the subsequent frame. Meanwhile, since the reference potential of a pixel voltage is the common electrode potential, fluctuations of potential applied to the common electrode should be considered in considering the disturbance potential fluctuation likely causing potential fluctuations from the intended potential in the pixel electrode by a DC voltage. In other words, considering the potential of the gate line that fluctuates corresponding to change of the potential of the common electrode between Vc and 0, the gate line is assumed to be varied inversely between Vc/2 and −Vc/2 every inversion period (3H in this embodiment) of the common electrode potential. The gate line is coupled to the pixel electrode via Cgb-pixel, CgdTFT and Cgbnext. Therefore, after some line is once written, the pixel electrode of the line undergoes the effect of potential fluctuations at ends of Cgb-pixel, CgdTFT and Cgbnext due to potential inversion of the gate line until the line is newly written in the next frame. The extent to which one line having been written is affected is mainly dependent on the number of times a potential with the polarity different from that of the common electrode at the time a line is written is applied from the common electrode until update of that line.

This number of times is the same as the number of inverse polarity driving times described above, and considering other respects in the same way, voltage losses Vloss_Csb_F and Vloss_Csb_L incurred in pixel electrodes of the first and latter written lines by potential fluctuations of the gate line are respectively:

$$\text{Vloss_Cgb_F} = \frac{1}{N}\left\{(L-1)\times\frac{Cgbpixel+Cgbnext}{Ctotal} + \text{Int}\left(\frac{N}{2}\right)\times\frac{Cgbpixel+Cgbnext}{Ctotal}\right\}\times Vc \tag{11}$$

$$\text{Vloss_Cgb_L} = \frac{1}{N}\left\{(L-1)\times\frac{Cgbpixel+Cgbnext}{Ctotal} + \text{Int}\left(\frac{N}{2}-M\right)\times\frac{Cgbpixel+Cgbnext}{Ctotal}\right\}\times Vc \tag{12}$$

where, Vc multiplied in each equation is a result of Vc/2−(−Vc/2).

From the considerations described above, voltages Vactual_F and Vactual_L respectively to which eventually the pixel electrodes of the first written line and the pixel electrode of the latter written line converge after fluctuating from the desired voltage Vc are as follows:

$$\begin{aligned}\text{Vactual_F} &= Vd - \text{Vloss_Cdd_F} - \text{Vloss_Csb_F} - \text{Vloss_Cgb_F}\\ &= Vd - \frac{2Cdd}{Ctotal}\times 2Vd - \frac{1}{N}\left\{(L-1)\times\frac{Csbpixel}{Ctotal} + \text{Int}\left(\frac{N}{2}\right)\times\frac{Csbpixel}{Ctotal}\right\}\times 2Vd - \frac{1}{N}\left\{(L-1)\times\frac{Cgbpixel+Cgbnext}{Ctotal} + \text{Int}\left(\frac{N}{2}\right)\times\frac{Cgbpixel+Cgbnext}{Ctotal}\right\}\times Vc\end{aligned} \tag{13}$$

$$\begin{aligned}\text{Vactual_L} &= Vd - \text{Vloss_Cdd_L} - \text{Vloss_Csb_L} - \text{Vloss_Cgb_L}\\ &= Vd - \frac{1}{N}\left\{(L-1)\times\frac{Csbpixel}{Ctotal} + \text{Int}\left(\frac{N}{2}-M\right)\times\frac{Csbpixel}{Ctotal}\right\}\times 2Vd - \frac{1}{N}\left\{(L-1)\times\frac{Cgbpixel+Cgbnext}{Ctotal} + \text{Int}\left(\frac{N}{2}-M\right)\times\frac{Cgbpixel+Cgbnext}{Ctotal}\right\}\times Vc\end{aligned} \tag{14}$$

[Causes of Artefacts]

1. Inter-line Artefact

Aforementioned equations (13) and (14) respectively represent actual voltages of pixel electrodes of the first written line and latter written line, and when their values have a difference therebetween, the difference shows a difference in brightness between lines, i.e. inter-line artefact. When the difference is Vloss(LbyL), the following equation holds:

$$\begin{aligned}Vloss(LbyL) &= \text{Vactual_F} - \text{Vactual_L}\\ &= \frac{2Cdd}{Ctotal}\times 2Vd + \frac{1}{N}\left\{\text{Int}\left(\frac{N}{2}\right) - \text{Int}\left(\frac{N}{2}-M\right)\right\}\times\left(\frac{Csbpixel}{Ctotal}\times 2Vd + \frac{Cgbpixel+Cgbnext}{Ctotal}\times Vc\right)\end{aligned} \tag{15}$$

As can be seen from the above-described equations (7) and (8), the potential fluctuation of the pixel electrode of the first written line is larger than the potential fluctuation of the pixel electrode of the latter written line. Accordingly, even in an attempt to display in the same brightness level, a difference arises in displayed brightness level between pixels of the first written line and pixels of the latter written line, and in the case of displaying gray on the whole of the screen, the pixels of the first written line would be brighter than the pixels of the latter write line. Such a fact that the potential fluctuation of the pixel electrodes of the first written line is relatively large is understood also from relationship between equations (9) and (10) and relationship between equations (11) and (12). This is because a value of the factor Int. (N/2−M) in equations (10) and (12) is obviously smaller than a value of the corresponding factor in equations (9) and (11), and values obtained by equations (10) and (12) are smaller than values obtained by equations (9) and (11), respectively.

Thus, in the alternate driving according to the fundamental technique, such a pattern appears that a brightness difference arises for each line even in an attempt to display in the same brightness level on the entire area of the screen. The characteristics depicted by a solid line in FIG. 10 show such a situation, and the first written lines (even-numbered lines) exhibit brightness significantly more different from the desired brightness (brightness corresponding to Vd) than the latter written lines (odd-numbered lines).

2. Intra-block Artefact

The intra-block artefact is caused by a factor for generating brightness variations in a displayed image of lines corresponding to a block and generating such brightness variations for each block. This factor is recognized to be (L−1) in the above equations (13) and (14). In other words, L represents the turn of a line selected in a block, and as a number of L increases (i.e. as a line is written later), the voltage deviates more from the desired voltage Vd in both the equations.

More specifically, a component representing a brightness variation amount in a block corresponds to a voltage fluctuation corresponding to a factor relating to (L−1) in equations (13) and (14), and is assumed as Vloss(Block). Vloss(Block) is as follows:

$$Vloss(\text{Block}) = \frac{1}{N}\left\{(L-1)\times\frac{Csbpixel}{Ctotal}\right\}\times 2Vd + \frac{1}{N}\left\{(L-1)\times\frac{Cgbpixel+Cgbnext}{Ctotal}\right\}\times Vc \tag{16}$$

Thus, in the alternate driving according to the fundamental technique (FIG. 6), in the case of displaying in the same brightness level on the entire area of the screen, even when the inter-line artefact component shown in FIG. 10 is removed, such a brightness variation occurs that the brightness gradually increases from the minimum value to the maximum value for each block with respect to a series of the lines as shown in FIG. 11. It is understood from this figure that in an attempt to display all the lines in the same brightness, lines selected later in a block have higher brightness, and in consistent ascending line selection of this embodiment, the brightness gradually increases in the vertical direction spatially on the screen on a block basis.

The technique to resolve the inter-line artefact is described in Japanese Patent Application Laid-Open No. 2001-108964 per se. In this conventional technique, source lines are beforehand supplied with, for example, bias voltages corresponding to the pattern of high-low alternating levels as shown in FIG. 10, or the bias voltage is multiplexed on a signal to supply to the source line, the potential difference between lines is thereby cancelled to resolve the artefact.

It is noted that the inter-line artefact and intra-block artefact are combined and the combination artefact appears, and the invention intends cancellation of the combined artefact, as well as each artefact. Embodiments 1-3 provide measures against the inter-line artefact without relying on the technique described in Japanese Patent Application Laid-Open No. 2001-108964, and Embodiments 4-9 provide measures against the intra-block artefact using features of Embodiments 1-3. Embodiments 4-9 concurrently provide measures against the inter-line artefact of Embodiments 1-3, but such measures may be replaced by anti-inter-line artefact measures as described in Japanese Patent Application Laid-Open No. 2001-108964. Further, techniques specific to Embodiments 4-9 themselves can be implemented irrespective of the presence or absence of anti-inter-line artefact measures. The embodiments according to the invention implemented based on the aforementioned considerations will specifically be described below.

Embodiment 1

An embodiment of measures against the inter-line artefact will be described with reference to FIG. 12.

FIG. 12 illustrates a manner of alternate driving performed by the addressing circuit 10 according to this embodiment in the same way as in FIG. 2. The line selecting order and polarity application style in the first frame are the same as in the example of the fundamental technique in FIG. 2 but ones in the second frame are different from in it. More specifically, while the same line selecting order is used in the first and second frames in FIG. 2, first written lines in the first frame are changed to latter written lines in the second frame in this embodiment. As can be seen from FIG. 12, in the first frame, the first, third and fifth lines are selected after the second, fourth and sixth lines in the beginning block. Meanwhile, in the second frame, the second, fourth and sixth lines are selected after the first, third and fifth lines in the beginning block. In other blocks, as in the forgoing, in the first frame even-numbered lines are first written lines and odd-numbered lines are latter written lines, but conversely, in the second frame the odd-numbered lines are first written lines and the even-number lines are latter written lines. In other words, the first half and latter half in the block in the first frame are in inverse order in the second frame.

By this means, the first written lines causing relatively large voltage losses in the first frame are handled as latter written lines with relatively small voltage losses in the second frame, so that such a relationship is provided between the first frame and the second frame that a brightness difference caused by a difference in voltage loss of each line is canceled, and it is thus possible to reduce visual failures caused by the difference in total voltage loss. For latter written lines in the first frame, there is inverse relationship, visual failures caused by the difference in voltage loss are similarly cancelled.

Thus, in displaying gray, the first frame has generally an image of the brightness pattern as shown in FIG. 10, while the second frame has an image of the inverse brightness pattern as shown in FIG. 13, whereby the average display brightness of each line is generally the same, and it is possible to cancel the inter-line artefact.

FIG. 14 illustrates the operation manner according to this embodiment in the same table format as in FIG. 6.

Embodiment 2

This embodiment is to improve Embodiment 1. In Embodiment 1, first written lines and latter written lines are exchanged whenever the frame is switched. However, it has been proved that the effect of reducing the voltage loss is insufficient in some part from the review of contents shown in FIG. 14.

Focusing attention on the sixth and seventh lines in the second frame, the sixth line is driven as a latter written line, and the seventh line is subsequently driven as a first written line. At this point, since the sixth line adjoins to the seventh line, the sixth line is affected at the time the seventh line is written. In other words, since the pixel electrodes of the seventh line are coupled with the pixel electrodes of the sixth line via Cdd, the desired voltages applied to the pixel electrodes of the sixth line are varied by the writing of the seventh line. The reason why the sixth line is handled as a latter written line is that handling the sixth line as a first written line in the first frame causes a large voltage loss, and so the sixth line should be handled as a latter written line with a small voltage loss in the second frame. Nevertheless, the sixth line suffers a large voltage loss also in the second frame due to the writing of the adjacent seventh line. Accordingly, the pixel electrodes of the sixth line causes a large voltage loss in either frames, and there is a risk that pixels corresponding to the sixth line locally make display extremely different brightness. The same respect applies to the 12th and 13th lines, the 18th and 19th lines, the 24th and 25th lines and the 30th and 31st lines.

This embodiment is to take measures against such a respect, and FIG. 15 illustrates the operational manner. In this embodiment, timing to drive the sixth line is shifted in the second frame. More specifically, the sixth line is not selected in the beginning block in the second frame and is selected in the subsequent block, and after selecting the sixth line, even-numbered lines subsequent to the sixth line are sequentially selected. Accordingly, only two lines are selected in the latter half of the beginning block in the second frame.

In this way, all the lines handled as first written lines in the first frame are handled as latter written lines under conditions or circumstances with relatively small voltage loss, and therefore, it is possible to solve the problem that the voltage loss is locally doubled as described above.

As means for solving the same problem, the example in FIG. 15 may be modified as shown in FIG. 16. FIG. 16 shows the modification, where selection timing part of first latter written line (even-numbered line) is treated as a dummy (D) in the latter half of the beginning block in the second frame, and subsequent latter written lines are sequentially assigned to each block in compliance with the prescribed number. For example, an auxiliary line is provided adjacent to the first line in a location outside the effective display area, and the auxiliary line is selected after selecting the fifth line and driven with a predetermined polarity. In this example, the auxiliary line adjoins to the first line driven with the positive polarity in the second frame, and therefore, is desirably driven with the negative polarity by reason of uniformly providing the voltage loss.

Alternatively, a time interval for one line is simply provided between selection timing of the fifth line and selection timing of the second line, whereby the operation equivalent to that using the auxiliary line is provided.

Embodiment 3

This embodiment is to further improve Embodiments 1 and 2, and such an improvement will be first described with reference to FIG. 17.

FIG. 17 shows a distribution of polarities of lines across the first and second frames in the operation according to Embodiment 1. '+' and '−' assigned to the fields represent positive polarity driving and negative polarity driving, respectively, and hatched fields indicate that the polarity is inverted at timing thereof and driving is started with the polarity shown in the fields.

Except for the hatched fields or states in which polarity inversion occurs, the number of line periods (H) with the positive polarity and the number of line periods (H) with the negative polarity in the first and second frames are checked for each line, and the resultant values are obtained at the right end of FIG. 17. For the first line, the line periods with '+' includes ten half blocks comprised of three lines, two half blocks comprised of one line, and two lines (the three and fifth lines in the second frame) belonging to the half block to which the positively driven first line belongs, and therefore, corresponds to $34H=3\times10+1\times2+2$. The line periods with '−' includes eight half blocks comprised of three lines, two half blocks comprised of one line, and two lines (the three and fifth lines in the first frame) belonging to the half block to which the negatively driven first line belongs, and therefore, corresponds to $28H=3\times8+1\times2+2$. Accordingly, the first line has 34H of positively driving states and 28H of negatively driving states in the first and second frames, and a difference Δ in the number of line periods is 6H. It is, therefore, understood that the positively driving states exist 6H longer than the negatively driving states. By performing same calculation on the second and subsequent lines, deviations in driving polarity can be found on all the lines.

It is understood from the values shown at the right side of FIG. 17 that positively driving states are dominant on either line in the first and second frames, and deviation to a positive polarity from the predetermined reference voltage can be found. In the first embodiment, since image display operation is performed by alternately repeating the first frame and second frame, when the operation is continued, such a tendency (voltage offset) continues that each line and eventually the entire display area approach to a non-negligible value with the positive polarity from the reference voltage, whereby a DC voltage is applied to the liquid crystal as a result, and unfavorably the need may arise for a voltage value of the common electrode signal to be adjusted and/or the centre of gray scale of display may be shifted.

In this embodiment, third and fourth frames are added to the driving manner to resolve such a problem, and FIG. 18 illustrates the resultant driving manner.

FIG. 18 illustrates the driving manner of the third and fourth frames subsequent to the first and second frames in FIG. 17 (FIG. 14), and this embodiment is directed to sequential repetition of the first to fourth frames. In this driving manner, the line selecting order in the second frame in FIG. 17 is maintained with the driving polarity being inverted in the third frame, and the line selecting order in the first frame in FIG. 17 is maintained with the driving polarity being inverted in the fourth frame.

FIG. 18 also shows each value indicating the deviation of the polarity at its right side. It is understood that these values are inversed on '+' and '−' with respect to the corresponding values shown in FIG. 17, and that signs of values of Δ are inverted from those in FIG. 17. Accordingly, when the values of Δ in FIG. 18 and the corresponding values in FIG. 17 are added for each line, all sums are just zero. Accordingly, by using the third and fourth frames after the first and second frames, and performing the image display operation repeatedly using the four frames, it is possible to implement driving without voltage offset and to avoid the problems as described above.

(Other Forms)

FIGS. 19 and 20 show another form of this embodiment constituted for the same purpose. This form is based on Embodiment 2 shown in FIG. 15, where the first and second frames shown in FIG. 19 (FIG. 15) are followed by the third and fourth frames shown in FIG. 20, and the first to fourth frames are repeated sequentially. Then, in the third frame, the line selecting order in the second frame in FIG. 19 is maintained with the driving polarity being inverted. In the fourth frame, the line selecting order in the first frame in FIG. 19 is maintained with the driving polarity being inverted.

In this form, for example, the sixth line has a specific derivation value Δ=12 in the first and second frames, while having a value Δ=−12 in the third and fourth frames. Therefore, all sums are also just zero when the values of Δ in FIG. 19 and the corresponding values in FIG. 20 are added. Accordingly, also in this form, by repeating the first to fourth frames sequentially, it is possible to obtain the same effects and advantages as in the above-mentioned form.

It is noted that it is apparent, in the same import, to be able to make a constitution having the third and fourth frames based on the example shown in FIG. 16. Further, the third frame is provided with the same line selecting order and inverse driving polarity as/to the second frame, while the fourth frame is provided with the same line selecting order and inverse driving polarity as/to the first frame. However, required is adding frames with inversion patterns to distribution patterns of driving polarity in the first and second frames as shown in FIGS. 17 and 19. More specifically, the fourth frame may be provided with the same line selecting order and inverse driving polarity as/to the second frame while the third frame is provided with the same line selecting order and inverse driving polarity as/to the first frame, or the first and second frames are alternately repeated for a first predetermined length of period, and thereafter suitable third and fourth frames are alternately repeated for the same predetermined length of period.

Thus, by providing additional frames with deviations to cancel deviations in driving polarity in the first and second frames for each line, it is possible to implement driving without voltage offset and to avoid the problems as described above.

Embodiment 4

One of embodiments for anti-intra-block artefact measures is to perform driving to provide a brightness variation as shown in FIG. 21 in displaying certain gray on the entire screen. The brightness variation obtained by driving by the fundamental technique as shown in FIG. 11 provides a remarkable change in brightness between blocks from the positive peak to the negative peak (for example, between the sixth and seventh lines). By decreasing such a change in brightness and gradually changing the brightness from the positive and negative peaks as shown in FIG. 21, the intra-block artefact becomes less visible.

FIG. 22 illustrates a driving manner according to this embodiment constituted based on the aforementioned conception. FIG. 22 is depicted in the same way as in FIG. 6 etc. Based on the previous consideration that lines selected later in a block have higher brightness in displaying all the lines with the same brightness (see FIG. 11), this embodiment is to break the rule that lines are selected in ascending order in all the blocks as in FIG. 15, and switch the line selecting order between the ascending order and descending order for each block to provide the brightness variation as in FIG. 21.

More specifically, as shown in FIG. 22, lines are selected in ascending order along the downward arrow in the first block while lines are selected in descending order along the upward arrow in the second block, and from then on, the ascending order and descending order are alternately repeated for each block. By this means, a line spatially closer to a line selected later in a block is selected later in the subsequent block, while a line spatially closer to a line selected earlier in a block is selected earlier in the subsequent block. Accordingly, it is made possible to select adjacent lines with a less brightness difference between blocks, and as a result, it is possible to obtain brightness variation characteristics as shown in FIG. 21.

Although in this embodiment the line selecting order in a block is either the ascending order or descending order, it may be possible that a preceding half block in a block is provided with one of the ascending order and descending order, while the following half block is provided with the other one.

It is noted that also in this embodiment, it is possible to add suitable third and fourth frames or any necessary additional frame(s) to take measures against the voltage offset as described previously, and such a case leads to a more effective form. This respect likewise applies to embodiments described below.

Embodiment 5

Another embodiment of anti-intra-block artefact measures is to perform driving to provide brightness variations as shown in FIG. 23 in displaying certain gray on the entire screen. The first frame is provided with a brightness variation shown by a solid line in FIG. 23 (the same as in FIG. 11), while the second frame is provided with another brightness variation shown by a dotted line in the figure. It is determined that a line with the minimum brightness value in the first frame has the maximum value in the second frame, and that a line with the maximum brightness value in the first frame has the minimum value in the second frame. Further, the brightness variation in the second frame is determined to have an inclination such that the value gradually decreases from the maximum value to the minimum value, inversely to the first frame. By doing so, it is possible to make the intra-block artefact less visible.

FIG. 24 illustrates a driving manner according to this embodiment constituted based on the above-mentioned conception. This embodiment is also based on the previous consideration that lines selected later provide higher brightness in a block in displaying all the lines with the same brightness (see FIG. 11). As shown in FIG. 24, lines are selected in ascending order in all the blocks in the first frame as in FIG. 14 (Embodiment 1), while lines are selected in descending order in all the blocks in the second frame. By this means, lines with the maximum and minimum brightnesses in the first frame respectively have the minimum and maximum brightnesses in the second frame, while the inclination from the minimum brightness to the maximum brightness in the first frame can be changed to an inclination from the maximum brightness to minimum brightness in the second frame, and as a result, it is possible to obtain brightness variation characteristics as in FIG. 23.

Embodiment 6

A further embodiment of anti-intra-block artefact measures is to perform driving to provide brightness variations as shown in FIG. 25 in displaying gray on the entire screen. The first frame is provided with a brightness variation shown by a solid line in FIG. 25 (the same as in FIG. 21), while the second frame is provided with another brightness variation shown by a dotted line in the figure. It is intended herein to generally invert the brightness variation pattern shown in FIG. 21 for each frame, and it is determined that a line with the minimum brightness value in the first frame has the maximum value in the second frame, and that a line with the maximum brightness value in the first frame has the minimum value in the second frame. Further, the brightness variation in the first frame and the brightness variation in the second frame are determined so that the inclination is inversed in the corresponding lines between frames. By this means, it is possible to make the intra-block artefact less visible than in the manner described in FIG. 21.

FIG. 26 illustrates a driving manner according to this embodiment constituted based on the above-mentioned conception. This embodiment is also based on the previously described consideration that lines selected later provide higher brightness in a block in displaying all the lines with the same brightness (see FIG. 11). As shown in FIG. 26, the line selecting order is switched between the ascending order and descending order alternately for each block in the first frame as in FIG. 22 (Embodiment 4), while such ascending order and descending order are inversed in the second frame. By this means, as a result, it is possible to obtain brightness variation characteristics as in FIG. 25.

Embodiment 7

Still another embodiment is to perform driving to provide brightness variations as shown in FIG. 27 in displaying gray on the entire screen. The first frame is provided with a brightness variation shown by a solid line in FIG. 27 (the same as in FIG. 11), while the second frame is provided with another brightness variation shown by a dotted line in the figure. Herein, the second frame is determined in the form of shifting the brightness variation pattern in FIG. 11, so that a line exactly on the centre between a line with the minimum brightness value and a line with the maximum value in the first frame has the maximum value in the second frame. By this means, it is possible to make the intra-block artefact less visible than in the manner described in FIG. 11.

FIG. 28 illustrates a driving manner according to this embodiment to implement the foregoing. According to this embodiment, both in the first and second frames, lines are selected in ascending order in all the blocks as in FIG. 15 (Embodiment 2), while the second frame is featured. More specifically, with a block structure comprised of three odd-numbered (first written) lines and three even-numbered (latter written) lines being broken, the beginning block of the second frame is comprised of two odd-numbered lines and one even-numbered line. In other words, instead of having six lines, the beginning block has half of it, three lines. By this means, the selection pattern of lines constituting the next block is shifted, and it is possible to exhibit the peak of brightness from the next block. As a result, it is possible to obtain brightness variation characteristics as shown in FIG. 27.

Embodiment 8

Furthermore, an embodiment may be possible to perform driving to provide brightness variations as shown in FIG. 29 in displaying certain gray on the entire screen. The first frame is provided with a brightness variation shown by a solid line in FIG. 29 (the same as in FIG. 21), while the second frame is provided with another brightness variation shown by a dotted line in the figure. Herein, the brightness variation pattern is determined by shifting that in FIG. 21 so that a line generally on the centre between a line with the minimum brightness value and a line with the maximum value in the first frame has the maximum value in the second frame. By this means, it is possible to make the intra-block artefact less visible than in the manner described in FIG. 21

FIG. 30 illustrates a driving manner according to this embodiment to implement the foregoing. Although this embodiment is based on Embodiment 4 in FIG. 22, it is intended to form the beginning block in the second frame with line selection in descending order and to reduce the number of lines selected in the beginning block to implement the shifting of the brightness variation pattern described above. Then, in the subsequent blocks, line selection is performed in ascending order-and descending order alternately as shown in FIG. 22. It is thus possible to obtain brightness variation characteristics as shown in FIG. 29.

Embodiment 9

Furthermore, an embodiment may be possible to perform driving to provide brightness variations as shown in FIG. 31 in displaying certain gray on the entire screen. The first frame is provided with a brightness variation shown by a solid line in FIG. 31 (the same as in FIG. 1), while the second frame is provided with another brightness variation shown by a dotted line in the figure. Herein, a period of the brightness variation in the first frame is different from a period of the brightness variation in the second frame, and the inclination in brightness variation is determined to be inversed between the first and second-frames. By this means, it is possible to make the intra-block artefact less visible than in the manner described in FIG. 11.

FIG. 32 illustrates a driving manner according to this embodiment to implement the foregoing. This embodiment is based on Embodiment 5 in FIG. 24, and each block consists of two odd-numbered lines (first written lines) and two even-numbered lines (latter written lines) in the second frame, while line selection for each block is set in descending order. It is thus possible to obtain brightness variation characteristics as shown in FIG. 31. According to this embodiment, artefacts in the first and second frames are agitated in an image, and it is possible to reduce the visibility of each artefact.

To clarify the relationship in inclination of the brightness variation pattern between the first and second frames that is less clarified in the example of FIGS. 31 and 32, another example is shown in FIGS. 33 and 34, which is constituted in the same idea. In this example, each block is comprised of twelve lines in the first frame, while being comprised of eight lines in the second frame.

It should be noted that the aforementioned embodiments and modifications are capable of being further changed and/or modified. For example, the alternate driving pattern shown in FIG. 3 can be changed to the dot-by-dot alternate pattern as shown in FIG. 35. Further, the examples have been described in the foregoing that a line first selected in the beginning block in the first frame is an even-numbered line driven with the positive polarity. However, such a line may be driven with the negative polarity, or an odd-numbered line. Furthermore, frame period, block period, and the number of lines to be selected in a half block are naturally not limited to the numbers described in the examples.

Besides, when implementing the above embodiments, a connection manner between the gate driver 60 as row driving means and the liquid crystal display panel 20 are preferably designed as follows.

FIG. 36 schematically shows a configuration of the gate driver 60 and relations between the configuration and gate lines of the panel 20. In FIG. 36, the gate driver 60 comprises a shift-register 61 and a switching section 62 for reassignment of outputs of the shift-register. The shift-register 61 is composed of a plurality of unit registers (611-6132) cascaded from a front end unit register 611 to a tail end unit register 6132.

In the shift-register 61, a significant output (e.g. a high voltage output) of a unit register to the side of the front end unit register 611 is sequentially shifted to a unit register to the side of the tail end unit register 6132 for each horizontal scanning period while the significant output causes the row electrode of the display panel 20 to be active.

By means of a switching section 62, the outputs of the unit registers are connected to the row electrodes of the display panel 20, respectively in such a manner that the sequential shifting operation leads to the realization of the row electrode selecting order as in the above-mentioned embodiments. In the embodiment of FIG. 12 for instance, the second, fourth, first, third and fifth lines, . . . are selected in this order in the first frame, along which outputs of the first, second, third, fourth, fifth and sixth unit registers, . . . are individually connected to the lines, respectively, as shown by wiring of solid arrows in the figure. In addition, the first, third, fifth, second, fourth, and sixth lines, . . . are selected in this order in the second frame, along which outputs of the first, second, third, fourth, fifth and sixth unit registers, . . . are individually connected to the lines, respectively, as shown by wiring of dotted arrows in the figure.

By so doing, it is possible to make the gate lines to be active in the desired order according to the above embodiments only by doing the sequentially shifting operation of the shift-register conventionally from its one end side to the other end side. This can prevent necessary complication of an inner structure of the gate driver 60 to mitigate the artifact.

It is noted that the switching section 62 can be implemented by a well-known analog switch array. Alternatively, when the row selecting pattern is not switched for each frame, the switching section 62 is not necessary, and it suffices to connect the outputs of the shift-register 61 directly to the row electrodes with wirings adapted to the desired selecting order.

In addition, although the above example is intended to provide the switching section 62 to switch a connection manner of the outputs of the shift-register 61 and the gate lines between the first and second frames, there may instead be adopted such a configuration that a shift-register for the first frame and another shift-register for the second frame are provided, and each of the shift-registers is fixedly connected to the gate lines in the corresponding manner, wherein any one of the shift-registers is acted but the other one is out of action during a frame associated with the one.

Moreover, in each of the above-mentioned embodiments the matrix addressing circuit used in the liquid crystal display device has been described, but the invention is not limited thereto, and applicable as appropriate to any display devices as far as they use the matrix addressing circuit as described herein.

Representative embodiments according to the invention have been described above, but the invention is not limited to them, and various modifications can be found by those skilled in the art within the scope of the appended claims.

EXPLANATION OF LETTERS OR NUMERALS

10 . . . matrix addressing circuit
20 . . . liquid crystal display panel
21 . . . TFT
23 . . . pixel electrode
25 . . . common electrode
30 . . . timing control and voltage producing circuit
40 . . . memory
50 . . . source driver
60 . . . gate driver
P1, P2 . . . pixel electrode

The invention claimed is:

1. A matrix addressing method for alternately driving pixels arranged in matrix, wherein:

a plurality of row electrodes extending in a horizontal direction of a display screen are made to be selectively active for each horizontal scanning period of images to be displayed;

a plurality of column electrodes extending in a vertical direction of the display screen are supplied with respective pixel voltages that are responsive to the image and correspond to the horizontal scanning period while the pixel voltages have polarities alternating for each frame period of the images;

the pixel voltages have polarities alternating in the vertical direction spatially in a display area within the frame period;

the frame period of the images is formed by successively sequencing on a time series a plurality of block periods, the block periods each being composed of a first half block and a second half block, the first half block being a period for successively sequencing on a time series application timings of the pixel voltages for one or more row electrodes to be provided with a first polarity, the second half block being a period for successively sequencing on a time series application timings of the pixel voltages for one or more row electrodes to be provided with a second, opposite polarity; and a corresponding row electrode is made to be active in synchronization with each of the application timings of the pixel voltages for the row electrodes, wherein ones of even-numbered row electrodes and odd-numbered row electrodes in arrangement order on the display screen are selected in the first half block; the others spatially adjoining the ones are selected in the second half block; a row electrode selecting order in the first half block and a row electrode selecting order in the second half block during one frame period are made differed from orders in corresponding first and second half blocks during the other frame period, respectively, so as to mitigate block-period-base visual artifact, wherein a row electrode selecting order is reversed between the first and second half blocks in one frame period and the corresponding first and second half blocks in the other frame period, and wherein in at least two frame periods, there are a block period in which each of row electrode selecting orders in the first and second half blocks is ascending order and a block period which corresponds to said block period and in which each of row electrode selecting orders in the first and second half blocks is descending order.

2. A method as defined in claim 1, wherein each of row electrode selecting orders in the first and second half blocks of each block period is set to ascending order in one frame period, and each of row electrode selecting orders in the first and second half blocks of each block period is set to descending order in the other frame period.

3. A method as defined in claim 1, wherein successive first to fourth frame periods, a row selecting pattern defined in the first frame period is used for one of the third and fourth frame periods and a row selecting pattern defined in the second frame period is used for other one of the third and fourth frame periods, in which the image is formed by repetition of the first to fourth frame periods or by a frame period sequence including the first to fourth frame periods, so that a frequency with which a drive polarity is the first polarity is substantially equal to a frequency with which a drive polarity is the second polarity for each row electrode.

4. A matrix addressing method for alternately driving pixels arranged in matrix, wherein:

a plurality of row electrodes extending in a horizontal direction of a display screen are made to be selectively active for each horizontal scanning period of images to be displayed;

a plurality of column electrodes extending in a vertical direction of the display screen are supplied with respective pixel voltages that are responsive to the image and correspond to the horizontal scanning period while the pixel voltages have polarities alternating for each frame period of the images;

the pixel voltages have polarities alternating in the vertical direction spatially in a display area within the frame period;

the frame period of the images is formed by successively sequencing on a time series a plurality of block periods, the block periods each being composed of a first half block and a second half block, the first half block being a period for successively sequencing on a time series application timings of the pixel voltages for one or more row electrodes to be provided with a first polarity, the second half block being a period for successively sequencing on a time series application timings of the pixel voltages for one or more row electrodes to be provided with a second, opposite polarity; and a corresponding row electrode is made to be active in synchronization with each of the application timings of the pixel voltages for the row electrodes, wherein ones of even-numbered row electrodes and odd-numbered row electrodes in arrangement order on the display screen are selected in the first half block; the others spatially adjoining the ones are selected in the second half block; row electrode selecting orders in the first and second half blocks alternate between ascending order in one block period and descending order for another block period for each successive block period in a frame period, so as to mitigate block-period-base visual artifact, wherein a frame period has mixture of block periods in which each of row electrode selecting orders in the first and second half blocks is ascending order and block periods in which each of row electrode selecting orders in the first and second half blocks is descending order, and wherein ascending-ordered block periods are block periods in which each of row electrode selecting orders in the first and second half blocks is ascending order and descending-ordered block periods are block periods in which each of row electrode selecting orders in the first and second half blocks is descending order, and wherein the ascending-ordered block periods and the descending-ordered block periods being alternated with each other during one frame period, and each of row electrode selecting orders in the first and second half blocks in a block period corresponding to the ascending-ordered block period is descending order and each of row electrode selecting orders in the first and second half blocks in a block period corresponding to the descending-ordered block period is ascending order during the other frame period.

5. A matrix addressing method for alternately driving pixels arranged in matrix, wherein:

a plurality of row electrodes extending in a horizontal direction of a display screen are made to be selectively active for each horizontal scanning period of images to be displayed;

a plurality of column electrodes extending in a vertical direction of the display screen are supplied with respective pixel voltages that are responsive to the image and correspond to the horizontal scanning period while the pixel voltages have polarities alternating for each frame period of the images;

the pixel voltages have polarities alternating in the vertical direction spatially in a display area within the frame period;

the frame period of the images is formed by successively sequencing on a time series a plurality of block periods, the block periods each being composed of a first half block and a second half block, the first half block being a period for successively sequencing on a time series application timings of the pixel voltages for one or more row electrodes to be provided with a first polarity, the second half block being a period for successively sequencing on a time series application timings of the pixel voltages for one or more row electrodes to be provided with a second, opposite polarity; and a corresponding row electrode is made to be active in synchronization with each of the application timings of the pixel voltages for the row electrodes, wherein ones of even-numbered row electrodes and odd-numbered row electrodes in arrangement order on the display screen are selected in the first half block; the others spatially adjoining the ones are selected in the second half block; a row electrode selecting order in the first half block and a row electrode selecting order in the second half block during one frame period are made differed from orders in corresponding first and second half blocks during the other frame period, respectively, so as to mitigate block-period-base visual artifact, wherein the number of row electrodes selected in each block period is different between one frame period and the other frame period.

6. A method as defined in claim 5, wherein a specific frame period including an exceptional block period having the number of selected row electrodes different from that in other block periods is used every two frame periods or every predetermined number of frame periods.

7. A method as defined in claim 6, wherein the exceptional block period is used as a beginning block period in a frame period.

8. A method as defined in claim 5, wherein row electrodes selected in a preceding half block in the block period in one frame period are made row electrodes selected in a following half block in the block period in the next frame period.

* * * * *